US008033629B2

(12) United States Patent
Asauchi

(10) Patent No.: US 8,033,629 B2
(45) Date of Patent: Oct. 11, 2011

(54) LIQUID JETTING APPARATUS AND CONTROL METHOD FOR THE SAME

(75) Inventor: Noboru Asauchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 144 days.

(21) Appl. No.: 12/242,542

(22) Filed: Sep. 30, 2008

(65) Prior Publication Data

US 2009/0085942 A1 Apr. 2, 2009

(30) Foreign Application Priority Data

Oct. 1, 2007 (JP) ..... 2007-257391

(51) Int. Cl.
*B41J 29/38* (2006.01)

(52) U.S. Cl. ..... 347/14; 347/9; 347/10

(58) Field of Classification Search ..... 347/14
See application file for complete search history.

(56) References Cited

U.S. PATENT DOCUMENTS

2002/0191038 A1* 12/2002 Tsuji ..... 347/5
2007/0149044 A1* 6/2007 Asauchi ..... 439/534

FOREIGN PATENT DOCUMENTS

JP 06-226989 8/1994
JP 2001-146030 5/2001
JP 2002-370383 12/2002
JP 2003-112431 4/2003
JP 2004-299405 10/2004

* cited by examiner

*Primary Examiner* — Matthew Luu
*Assistant Examiner* — Brian Goldberg
(74) *Attorney, Agent, or Firm* — Kilpatrick Townsend & Stockton LLP

(57) ABSTRACT

A liquid jetting apparatus to which a liquid container is attached, the container containing a liquid and having a first device, includes a processor, a first line, a second line, a controller and a connecting module. The processor executes a prescribed process in relation to the liquid container. The first line is for electrical connection to the first device. The second line is for electrical connection to the processor. The controller, in a first instance, accesses the first device via at least the first line and that, in a second instance, accesses the processor via the second line to have the processor execute the prescribed process. The connecting module, in the second instance, electrically sets the first line to a fixed voltage.

11 Claims, 13 Drawing Sheets

DURING REMAINING INK LEVEL DETERMINATION

DURING MEMORY DEVICE ACCESS

LIQUID JETTING APPARATUS AND CONTROL METHOD FOR THE SAME

CROSS REFERENCE TO RELATED APPLICATIONS

This application relates to and claims priority from Japanese Patent Application No. 2007-257391, filed on Oct. 1, 2007, the entire disclosure of which is incorporated by reference.

BACKGROUND

1. Technical Field

The present invention relates generally to a liquid jetting apparatus and to a method of controlling the same; and relates in particular to a liquid jetting apparatus equipped with a liquid receptacle that is furnished with a device, and to a method of controlling the same.

2. Description of the Related Art

One example of a liquid jetting apparatus is a printing system of ink jet type which typically has one or more removable ink containers. Some such ink containers have a memory device. The memory device stores information of various kinds, for example the amount of remaining ink or the color of the ink inside the ink container. More recently, some ink containers include a sensor for detecting the remaining ink amount. A controller provided to the printing apparatus carries out control of the memory device of the ink container, as well as control of the sensor.

However, in the technology to date, control of the sensor by the printing apparatus is not designed with particular consideration to possible effects to memory devices. For example, there is a risk that the voltage used for controlling the sensor could have some unwanted effect on the control unit or on the memory devices through the agency of interconnections among the controller and the memory devices. This issue is not limited to instances of memory devices provided to ink containers, but is an issue common to many instances in which the liquid container is provided with some sort of electric or electronic device, and the controller of the liquid jetting apparatus has an interconnection with the device in question. Nor is this issue limited to instances of control of a sensor by the controller, and the issue is one common to instances where a prescribed process is carried out in relation to ink containers.

SUMMARY

The present invention is addressed to the issues mentioned above in relation to a liquid jetting apparatus to which a liquid container is attached, wherein the container has an electric or electronic device. An advantage of some aspects of the invention is to reduce the effects that a prescribed process carried out in relation to an ink container may have on the liquid jetting apparatus.

A first aspect of the invention provides a liquid jetting apparatus to which a liquid container is attached, the container containing a liquid and having a first device. The liquid jetting apparatus pertaining to the first aspect comprises a processor, a first line, a second line, a controller and a connecting module. The processor executes a prescribed process in relation to the liquid container. The first line is for electrical connection to the first device. The second line is for electrical connection to the processor. The controller, in a first instance, accesses the first device via at least the first line and that, in a second instance, accesses the processor via the second line to have the processor execute the prescribed process. The connecting module, in the second instance, electrically sets the first line to a fixed voltage.

According to the liquid jetting apparatus of the first aspect, when a prescribed process is carried out in relation to a liquid container, the first line is set to a fixed potential. It may be possible as a result to reduce electrical fluctuations produced on the first line by the prescribed process. As result, it may in turn be possible to reduce the effects on the liquid jetting apparatus of the prescribed process.

In the liquid jetting apparatus of the first aspect, the connecting module may further include a first driver that, in the second instance, brings the first line to a fixed voltage. In this case, electrical fluctuations produced on the first line by the prescribed process may be further reduced. As result, it may be possible to further reduce the effects on the liquid jetting apparatus of the prescribed process.

The liquid jetting apparatus of the first aspect may further comprise a detector capable of detecting if undesired voltage is applied to the first line due to the prescribed process. The connecting module may further include a second driver that brings the first line to a fixed voltage when the detector detects the undesired voltage. In this case, electrical fluctuations produced on the first line by the prescribed process may be reduced to an even greater extent. As result, it may be possible to reduce to an even greater extent the effects on the liquid jetting apparatus of the prescribed process.

In the liquid jetting apparatus of the first aspect, the liquid container may further include a second device. The liquid jetting apparatus may further include a third line for electrically connecting the first controller and the second device. The prescribed process may include application of driving voltage to the second device through the third line. Thus, in the event that driving voltage intended for a second device is misapplied to the first line, it may be possible to reduce the effects of the misapplied voltage.

In the liquid jetting apparatus of the first aspect, the undesired voltage due to the prescribed process or the driving voltage may be greater than a voltage of the first line without the undesired voltage. In such a case, the effects of driving voltage or of voltage in relation to a prescribed process will tend to be significant, but according to this configuration, the effects thereof on the liquid jetting apparatus may be reduced.

The liquid jetting apparatus of the first aspect may further comprise a first terminal for electrically connecting the first device of the liquid container to the first line, and a second terminal for electrically connecting the second device of the liquid container to the third line. The first terminal and the second terminal may be mutually closely situated. In such a case, the driving voltage tends to affect the liquid jetting apparatus, but according to this configuration, the effects of driving voltage on the liquid jetting apparatus may be reduced.

In the liquid jetting apparatus of the first aspect, the first device may include a memory device. The second device may include a sensor for sensing an amount of liquid contained in the liquid container, and the prescribed process may include a process for using the sensor to determine the amount of the liquid.

In the liquid jetting apparatus of the first aspect, in the first instance, the controller may connect the second line and the first line to access the first device via the second line and the first line.

Additionally, the present invention may be realized in various other aspects, such as a liquid jetting apparatus; a control method for a liquid jetting apparatus; a computer program for accomplishing such a method or functions of an apparatus; or a recording medium having such a computer program recorded thereon, for example.

The above and other objects, characterizing features, aspects and advantages of the invention will be clear from the description of preferred embodiments presented below along with the attached drawings.

DETAILED DESCRIPTION OF THE PREFERRED EMBODIMENTS

Embodiments of the present invention will be described below with reference to the drawings.

A. First Embodiment

Figure 1:
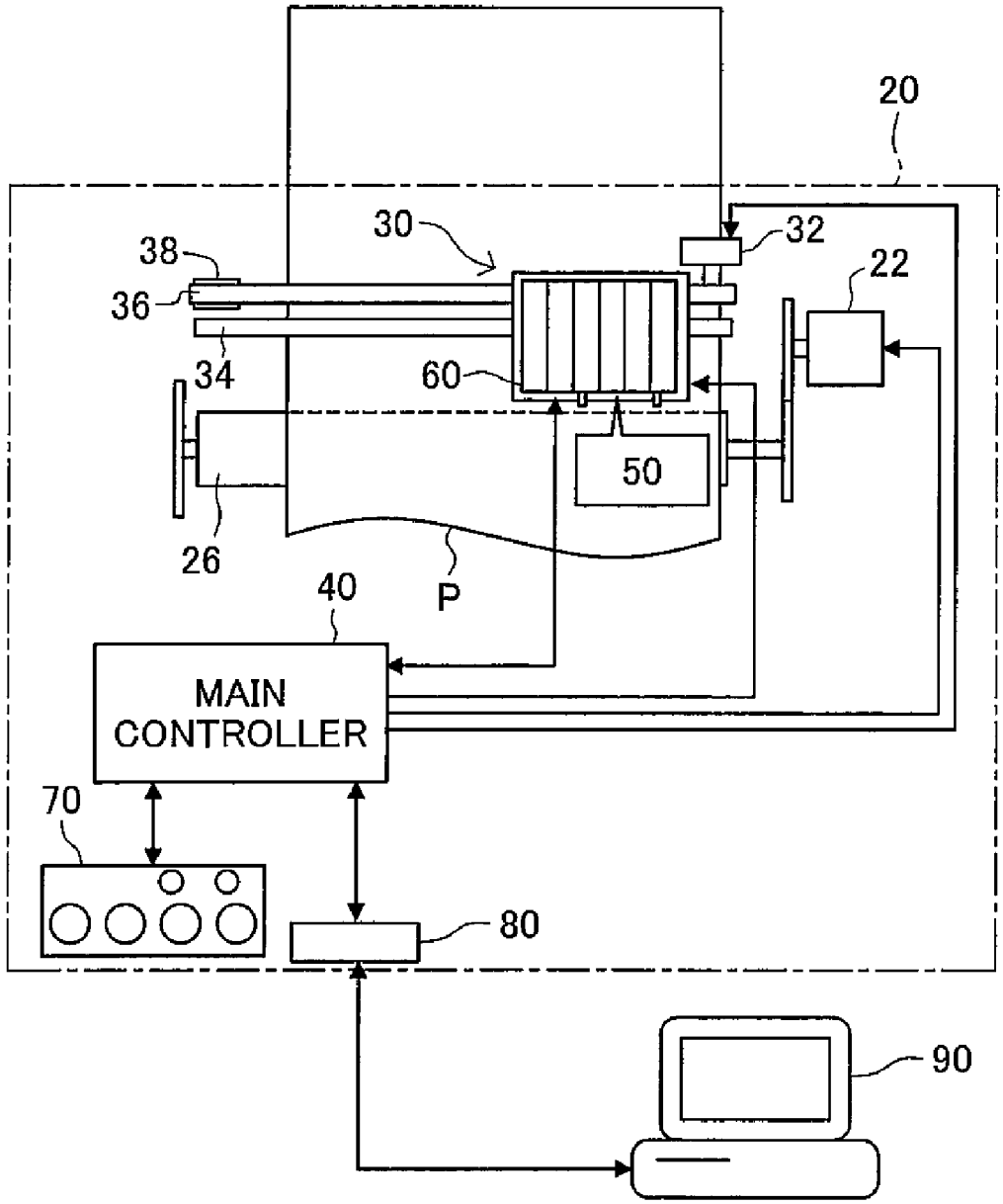
FIG. 1 is an illustration of a simplified configuration of a printing system in first embodiment.

The preferred embodiments for carrying out the invention will be described next. FIG. 1 is an illustration of a simplified configuration of a printing system in first embodiment. The printing system includes a printer 20 and a computer 90. The printer 20 is connected to the computer 90 via a connector 80.

The printer 20 includes a sub-scan feed mechanism, a main scan feed mechanism, a head driving mechanism, and a main controller 40 that controls these mechanisms. The sub-scan feed mechanism includes a paper feed motor 22 and a platen 26; paper P is advanced in the sub-scanning direction by transmitting the rotation of the paper feed motor to the platen. The main scan feed mechanism includes a carriage motor 32, a pulley 38, a drive belt 36 stretched between the carriage motor and the pulley, and a slide rail 34 extending parallel to the platen 26. The slide rail 34 slidably retains a carriage 30 that is affixed to the drive belt 36. The rotation of the carriage motor 32 is transmitted to the carriage 30 through the drive belt 36, whereby the carriage 30 reciprocates in the axial direction of the platen 26 (the main scanning direction) along the slide rail 34. The head driving mechanism includes a print head unit 60 that rests on the carriage 30; the print head is driven in order to eject ink onto the paper P. As will be discussed later, the print head unit 60 includes a plurality of detachably installed ink cartridges. The printer 20 also includes an operation section 70 that allows the user to make various printer settings or to check the status of the printer.

Figure 2:
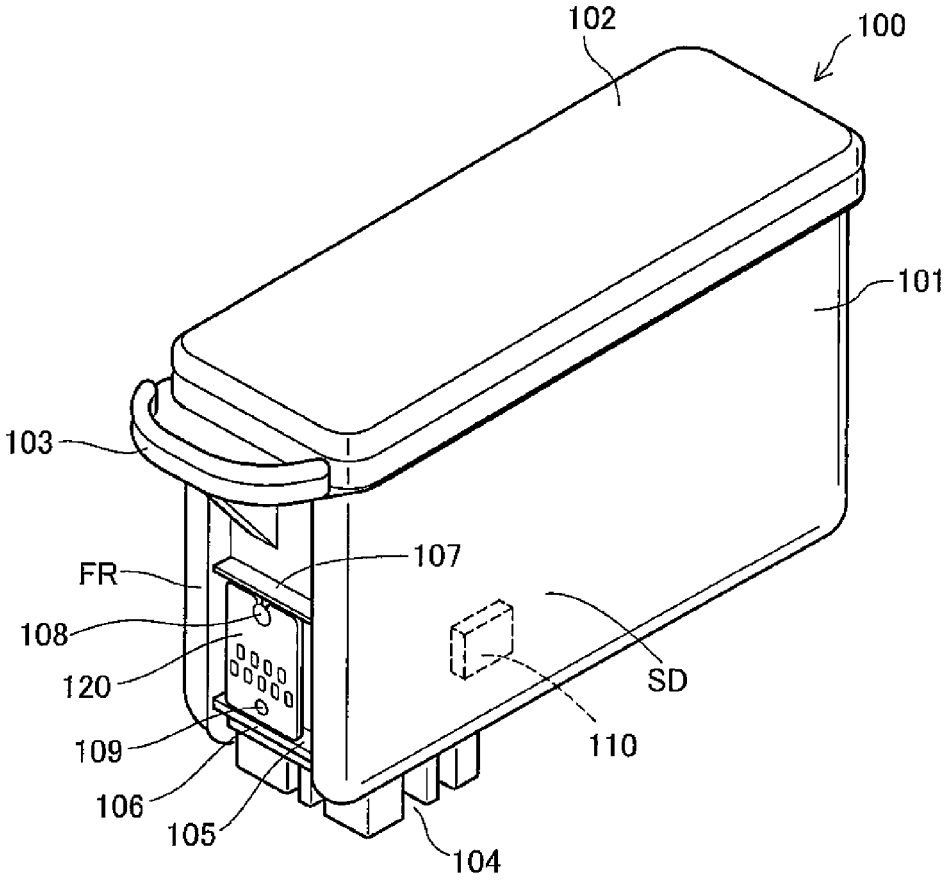
FIG. 2 is a perspective view depicting the configuration of an ink cartridge in the first embodiment.

The configuration of the ink cartridges (liquid container), as well as the configuration of the printer 20, will be discussed making reference to FIGS. 2 to 4. FIG. 2 is a perspective view depicting the configuration of an ink cartridge in the first embodiment. FIG. 3 is a diagram depicting the design of a board in the first embodiment. FIG. 4 is a diagram depicting the configuration of the print head unit 60.

The ink cartridge 100 includes a housing 101 containing the ink; a cover 102 for closing off the opening of the housing 101; a circuit board 120; and a sensor 110. On the bottom face of the housing 101 there is formed an ink supply port 104 for supplying ink to the print head unit 60 when the cartridge has been attached in the print head unit 60. A projecting portion 102 is formed at the upper edge of the front face FR of the housing 101 depicted in FIG. 2. Additionally, a recessed portion 105 framed at top and bottom by ribs 107 and 106 is formed on the front face FR of the housing 101, to the lower side of the center (bottom face side). The circuit board 120 mentioned above fits within this recessed portion 105. The sensor 110 is embedded in the side wall SD of the housing 101. The sensor, which will be discussed later, includes a piezoelectric element, and is used to detect the level of remaining ink.

Figure 3A:
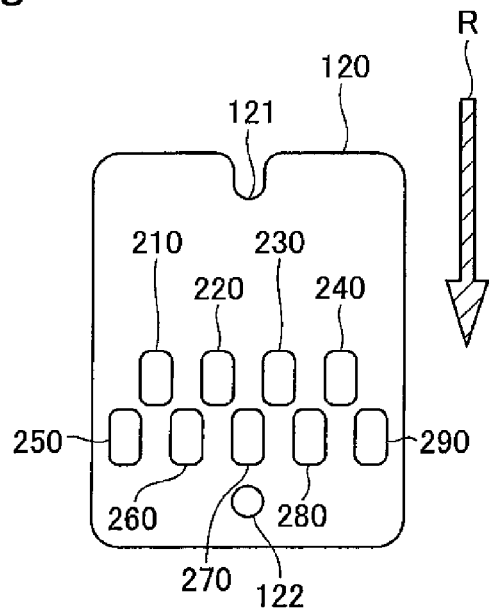
FIGS. 3A-B are diagrams depicting the design of a board in the first embodiment.
Figure 3B:
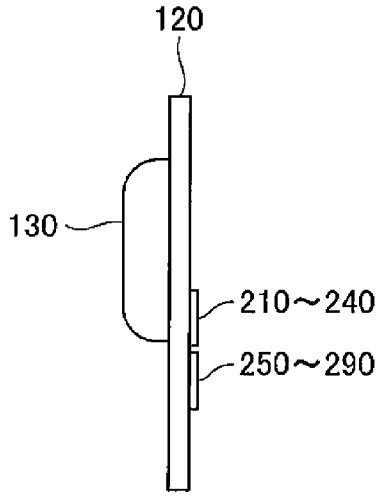
Figure 4:
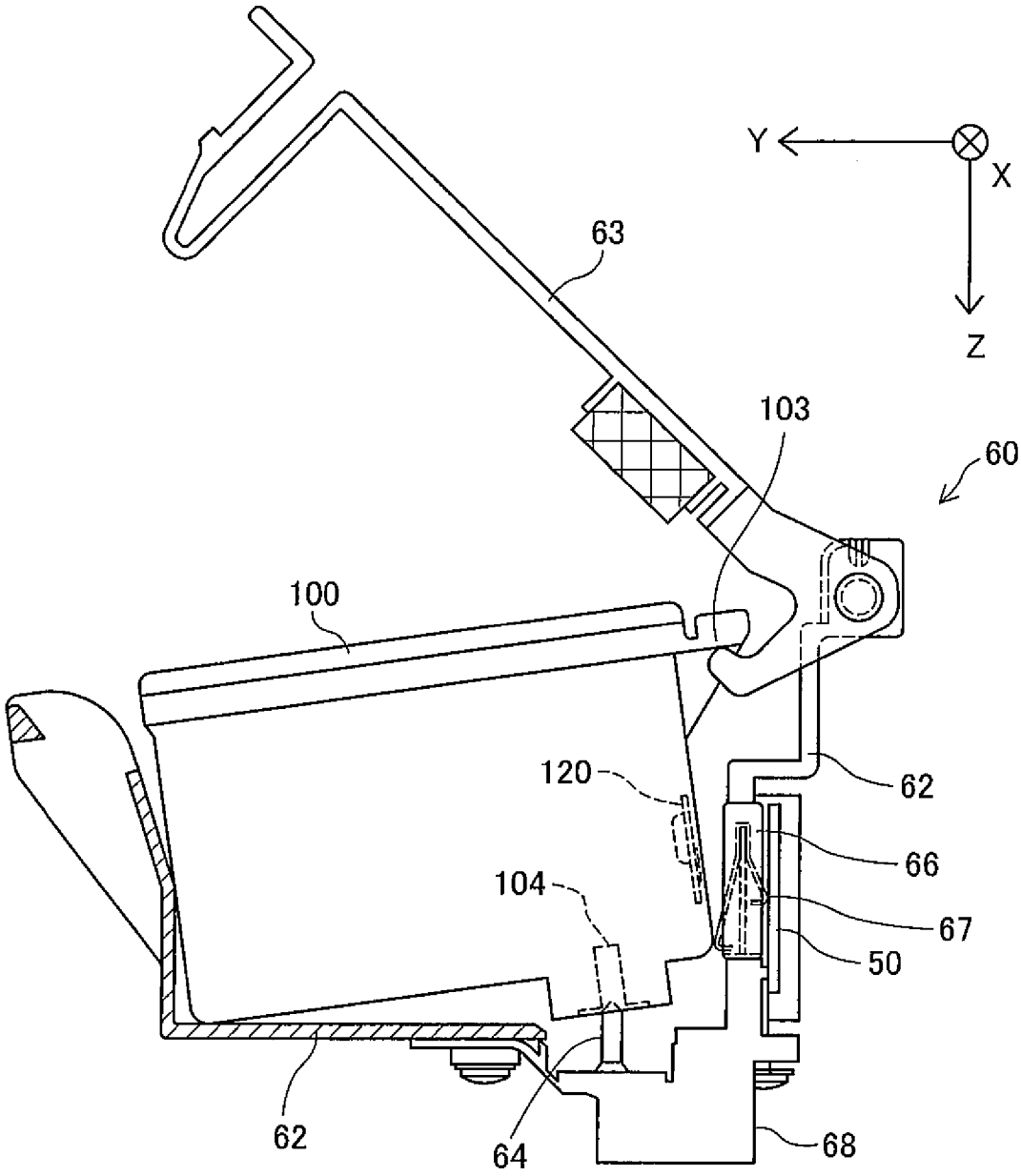
FIG. 4 is a diagram depicting the configuration of the print head unit.

FIG. 3A depicts the configuration of the surface of the circuit board 120. This surface is the face that will lie exposed towards the outside with the ink cartridge installed. FIG. 3B depicts the circuit board 120 seen in side view. A boss slot 121 is formed in the upper edge of the circuit board 120, and a boss hole 122 is formed at the lower edge of the circuit board 120. With the circuit board 120 installed within the recessed portion 105 of the housing 101 as depicted in FIG. 1, bosses 108 and 109 that have been formed on the bottom face of the recessed portion 105 will mate within the boss slot 121 and the boss hole 122. The distal ends of the bosses 108 and 109 are pressed down to rivet the board to the recessed portion 105.

The configuration of the print head unit 60 and installation of the ink cartridge 100 in the print head unit 60 will be described making reference to FIG. 4. As depicted in FIG. 4, the print head unit 60 includes a holder 62, holder covers 63, a connecting mechanism 66, a print head 68, and a carriage circuit 50. The holder 62 is adapted for detachable installation of the plurality of ink cartridges 100, and is positioned on the upper face of the print head 68. The holder covers 63 are provided on a one-to-one basis for the installed ink cartridges, and are respectively mounted openably and closably in the upper part of the print head 68. The connecting mechanism 66 includes electrically conductive connector terminals 67 for electrical connecting terminals (described later) provided on the circuit board 120 of the ink cartridge 100 and the carriage circuit 50, the connector terminals 67 being provided on a one-to-one basis for the terminals of the circuit board 120. Ink delivery needles 64 for delivering ink from the ink cartridge 100 to the print head 68 are situated on the upper face of the print head 68. The print head 68 includes a plurality of nozzles and a plurality of piezoelectric elements ("piezo elements"); in response to voltage applied to the piezoelectric elements, drops of ink will be ejected from the nozzles to produce dots on the paper P. The carriage circuit 50 is a circuit that in cooperation with the main controller 40 performs control in relation to the ink cartridges 100; hereinafter the carriage circuit 50 will also be referred to as the "sub-controller."

With the holder cover 63 in the open state, the ink cartridge 100 is placed in the holder 62, and when the holder cover is shut the ink cartridge 100 becomes secured in the holder 62.

With the ink cartridge 100 secured in the holder 62, the ink delivery needle 64 will pierce the ink supply port 104 so that the ink contained in the ink cartridge 100 is delivered to the print head 68 though the ink delivery needle 64. From the above it will be appreciated that the ink cartridge 100 is installed in the holder by inserting it in the forward direction of the Z axis in FIG. 4.

Returning now to FIG. 3, the circuit board 120 will be discussed further. The arrow R in FIG. 3A represents the direction of insertion of the ink cartridge 100 mentioned above. As depicted in FIG. 3B the circuit board 120 includes a memory device 130 situated on its back face, and on its front face has a terminal group composed of nine terminals. The memory device 130 includes a memory cell array; data of various kinds relating to the ink or to the ink cartridge 100, for example the level of remaining ink or the color of the ink, is stored in the memory cell array.

The terminals on the front face of the circuit board 120 are of generally oblong shape and are positioned so as to define two rows that extend generally orthogonal to the insertion direction R. Of the two rows, the one lying towards the insertion direction R, i.e. the row situated to the lower side in FIG. 3A, shall be termed the lower row; the one lying opposite from the insertion direction R, i.e. the row situated to the upper side in FIG. 3A, shall be termed the upper row. The terminals constituting the upper row and the terminals constituting the lower row are positioned at mutually different locations so that the center axes of the terminals do not line up with one another, in a so-called staggered arrangement.

The terminals that are arrayed to form the upper row are, in order from left in FIG. 3A, a first short detection terminal 210, a ground terminal 220, a power supply terminal 230, and a second short detection terminal 240. The terminals that are arrayed to form the lower row are, in order from left in FIG. 3B, a first sensor driving terminal 250, a reset terminal 260, a clock terminal 270, a data terminal 280, and a second sensor driving terminal 290. The five terminals situated in proximity to the center in the left-right direction, i.e. the ground terminal 220, the power supply terminal 230, the reset terminal 260, the clock terminal 270, and the data terminal 280, are respectively connected to the memory device 130 via wiring layer in the circuit board 120 (not shown). The two terminals situated at either end of the lower row, i.e. the first sensor driving terminal 250 and the second sensor driving terminal 290, are respectively connected to a first electrode and the other electrode of the piezoelectric element included in the sensor 110. The first short detection terminal 210 is shorted to the ground terminal 220. The second short detection terminal 240 is not connected to anything.

On the circuit board 120, the five terminals that are connected to the memory device 130 and the two terminals that are connected to the sensor 110 are situated in proximity to one another. For this reason, in the connecting mechanism 66 provided on the printer 20 side as well, the connector terminals 67 that correspond to the five terminals that are connected to the memory device 130; and the two connector terminals 67 that correspond to the two terminals that are connected to the sensor 110, are situated in proximity to one another. The memory device 130 and the sensor 110 in the embodiment correspond respectively to the first device and second device taught in the present invention.

When the ink cartridge 100 is secured in the holder 62, the terminals of the circuit board 120 will become electrically connected to the sub-controller (the carriage circuit) 50 via the connector terminals 67 of the connecting mechanism 66 that is provided to the holder 62.

Figure 5:
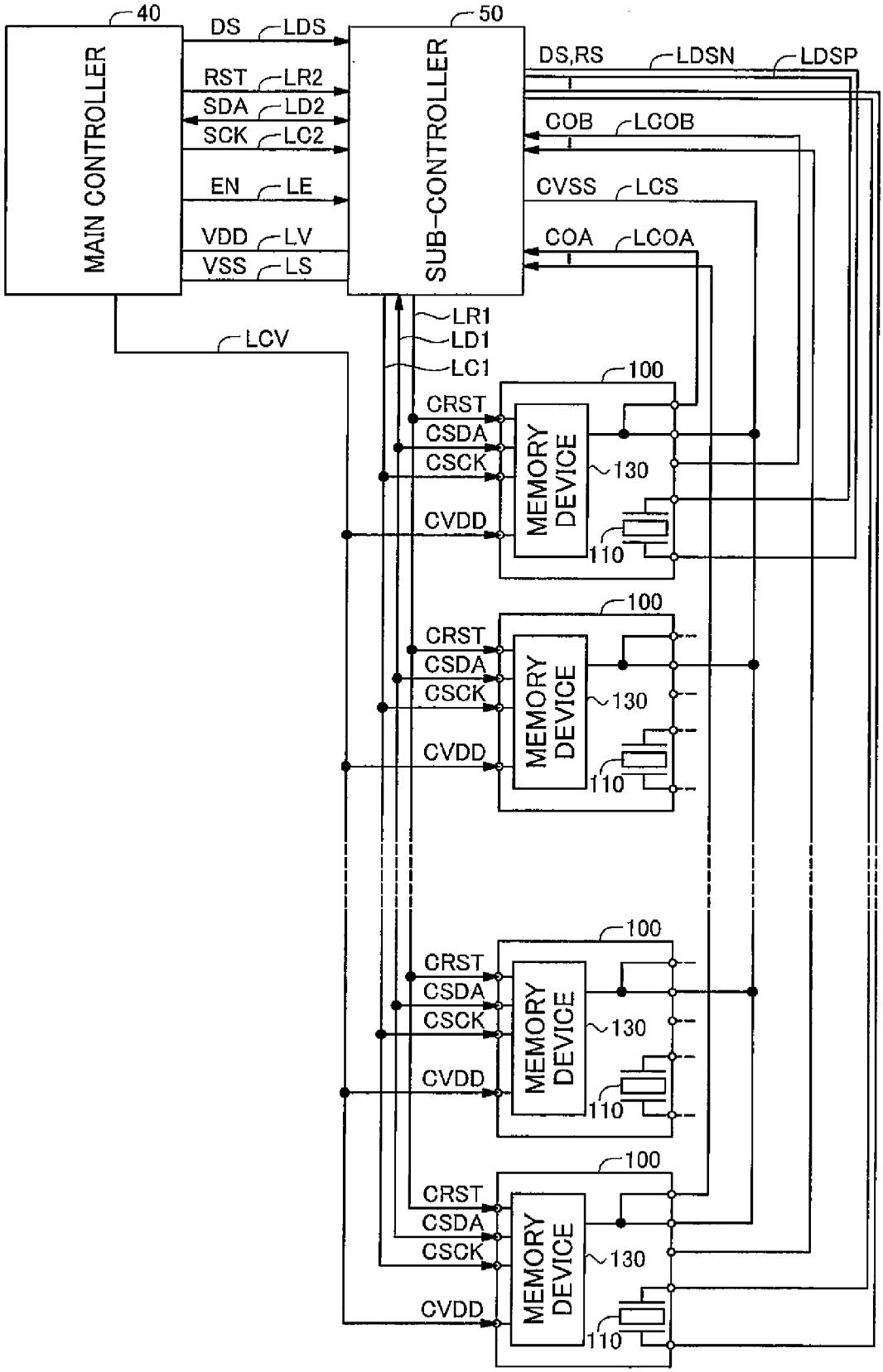
FIGS. 5 and 6 show he electrical configuration of the printer in the first embodiment.
Figure 6:
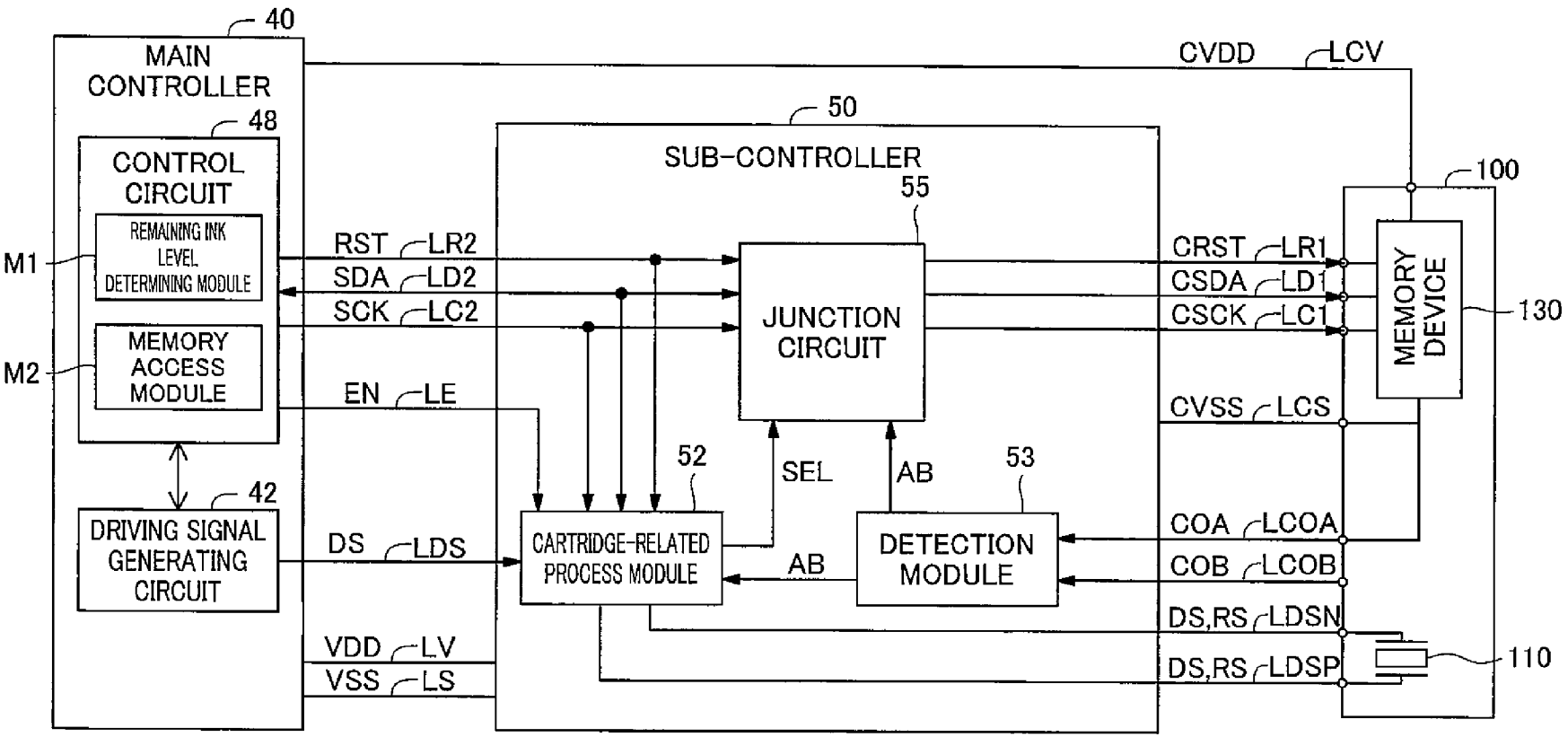

Electrical Configuration of Printing Apparatus:

The electrical configuration of the printer in the first embodiment will be described making reference to FIGS. 5 and 6. FIG. 5 focuses on the main controller 40, the sub-controller 50, and the cartridges 100 as a whole. FIG. 6 depicts the internal configuration of the main controller 40 and the internal configuration of the sub-controller 50, together with a single ink cartridge 100.

The sub-controller 50 and the memory devices 130 of the ink cartridges 100 are assigned mutually different 3-bit ID numbers (identification numbers). These ID numbers are used to specify a target device among the carriage circuit 50 and the memory devices 130. The target device is the target of the control by the main controller 40. In the event that there are six installed ink cartridges 100, length of each ID number is 3 bit. The sub-controller 50 would be assigned the ID "0,0,0" and the six memory devices 130 would be respectively assigned the IDs "0,0,1" to "1,1,0," for example.

The sub-controller 50 and the ink cartridges 100 are interconnected by a plurality of lines. The plurality of lines is composed of connector terminals 67 of the connecting mechanism 66, terminals on the front face of the circuit board 120 and wirings from the terminals to the memory device 130 or sensor 110. This plurality of lines include a first reset signal line LR1, a first data signal line LD1, a first clock signal line LC1, a first ground line LCS, a first short detection line LCOA, a second short detection line LCOB, a first sensor driving signal line LDSN, and a second sensor driving signal line LDSP.

The first reset signal line LR1 is a conductive line for transmitting a first reset signal CRST, and is electrically connected to the memory device 130 via the reset terminal 260 of the circuit board 120. The first data signal line LD1 is a conductive line for transmitting a first data signal CSDA, and is electrically connected to the memory device 130 via the data terminal 280 of the circuit board 120. The first clock signal line LC1 is a conductive line for transmitting a first clock signal CSCK, and is electrically connected to the memory device 130 via the clock terminal 270 of the circuit board 120. These three lines LR1, LD1, LC1 are respectively lines that have a single end on the sub-controller 50 side thereof, and that have on the ink cartridge 100 side branched ends equal in number to the ink cartridges 100. The three lines LR1, LD1, LC1 in this embodiment correspond to first lines in the present invention.

The first ground line LOS is a conductive line for supplying ground potential CVSS to the memory device 130 and is electrically connected to the memory device 130 by the ground terminal 220 of the circuit board 120. The first ground line LCS has a single end on the sub-controller 50 side thereof, and on the ink cartridge 100 side has branched ends equal in number to the ink cartridges 100. The ground potential CVSS is connected to a ground potential VSS (discussed later) that is supplied to the sub-controller 50 by the main controller 40, and is set to GND level.

The first short detection line LCOA and the second short detection line LCOB are conductive lines used for short detection, discussed later. The first short detection lines LCOA and the second short detection lines LCOB are a plurality of lines respectively provided independently on a one-to-one basis for the ink cartridges 100, and electrically connect at a first end thereof to the sub-controller 50, while electrically connecting at the other end to the first short detection terminal 210 and to the second short detection terminal 240 of the circuit board 120, respectively.

The first sensor driving signal line LDSN and the second sensor driving signal line LDSP are conductive lines for applying driving voltage to the piezoelectric element of the sensor 110, and for transmitting the voltage generated through the piezoelectric effect of the piezoelectric element to the sub-controller 50. The first sensor driving signal lines LDSN and the second sensor driving signal lines LDSP are a plurality of lines respectively provided independently on a one-to-one basis for the ink cartridges 100, and electrically connect at a first end thereof to the sub-controller 50, while electrically connecting at the other end to the first sensor driving terminal 250 and to the second sensor driving terminal 290 of the circuit board 120, respectively. The first sensor driving signal line LDSN electrically connects to one electrode of the piezoelectric element of the sensor 110 via the first sensor driving terminal 250, while the second sensor driving signal line LDSP electrically connects to the other electrode of the piezoelectric element of the sensor 110 via the second sensor driving terminal 290.

The main controller 40 and the ink cartridges 100 are interconnected by the first power supply lines LCV. The first power supply line LCV is a conductive line for supplying power supply potential CVDD to the memory devices 130, and connects to the memory device 130 via the power supply terminal 230 of the circuit board 120. The first power supply line LCV is a line that has a single end on the sub-controller 50 side thereof, and that has on the ink cartridge 100 side branched ends equal in number to the ink cartridges 100. The power supply potential CVDD that is used to drive the memory devices 130 employs potential of about 3.3 V versus ground potential CVSS (GND level). Of course, the potential level of the power supply potential CVDD could be a different potential, depending on factors such as the processor generation of the memory devices 130; 1.5 V or 2.0 V could be employed, for example.

The main controller 40 and the sub-controller 50 are electrically interconnected by a plurality of lines. The plurality of lines include a second reset line LR2, a second data signal line LD2, a second clock signal line LC2, an enable signal line LE, a second power supply line LV, a second ground line LS, and a third sensor driving signal line LDS.

The second reset line LR2 and the second clock signal line LC2 are conductive lines that are respectively used to transmit a second reset signal RST and a second clock signal SCK from the main controller 40 to the sub-controller 50. The second data signal line LD2 is a conductive line that is used to exchange a second data signal SDA between the main controller 40 and the sub-controller 50. The three lines LR2, LD2, LC2 in this embodiment correspond to second lines in the present invention.

The enable signal line LE is a conductive line for transmitting an Enable signal EN from the main controller 40 to the sub-controller 50. The second power supply line LV and the second ground line LS are conductive lines respectively used for supplying the power supply potential VDD and the ground potential VSS from the main controller 40 to the sub-controller 50. The power supply potential VDD is the same level as the aforementioned power supply potential CVDD that is supplied to the memory devices 130; potential of about 3.3 V versus ground potential VSS and CVSS (GND level) is employed, for example. Of course, the potential level of the power supply potential VDD could be a different potential, depending on factors such as the processor generation of the logic section of the sub-controller 50; 1.5 V or 2.0 V could be employed, for example.

The main controller 40 includes a control circuit 48 and a driving signal generating circuit 42.

The control circuit 48 includes a CPU and a memory, and executes overall control of the printer 20. The control circuit 48 includes, by way of function blocks for accomplishing some of its control functions, a remaining ink level determining module M1 and a memory access module M2. The ink level determining module M1 controls the sub-controller 50 and the driving signal generating circuit 42, in order to drive the sensor 110 of the ink cartridge 100 and detect the level of ink remaining in the ink cartridge 100. The memory access module M2 accesses the memory device 130 of the ink cartridge 100 through the sub-controller 50.

The driving signal generating circuit 42 also includes a memory, not shown. This memory stores data that represents a sensor driving signal DS for the purpose of driving the sensor. According to an instruction from the ink level determining module M1 of the control circuit 48, the driving signal generating circuit 42 will read the data from the memory and generate a sensor driving signal DS having the desired waveform. The sensor driving signal DS will include a higher potential than the power supply potential VDD (in this embodiment, 3.3 V); for example, in this embodiment, it includes a maximum potential of about 36 V. Specifically, the sensor driving signal DS is a pulsed signal having maximum voltage of 36 V.

In this embodiment, the driving signal generating circuit 42 is additionally capable of generating a head driving signal for presentation to the print head 68. Specifically, in this embodiment, when determination of remaining ink level is to be carried out, the control circuit 48 will instruct the driving signal generating circuit 42 to generate a sensor driving signal, while when printing is to be carried out, it will instruct the driving signal generating circuit 42 to generate a head driving signal.

The sub-controller 50 includes a cartridge-related process module 52, a detection module 53, and a junction circuit 55.

The cartridge-related process module 52 performs prescribed processes relating to the ink cartridges. The cartridge-related process module 52 includes a logic circuit composed of an ASIC or the like, and a changeover switch. The logic circuit is driven by the power supply potential VDD (in this embodiment, 3.3 V). The changeover switch is used to supply the sensor driving signal DS that has been generated by the driving signal generating circuit 42, to the sensor 110 of the ink cartridge 100 which is the target of the ink remaining level detection via either the first sensor driving signal line LDSN or the second sensor driving signal line LDSP. The cartridge-related process module 52 can exchange data with the control circuit 48 via the second reset signal line LR2, the second data signal line LD2, and the second clock signal line LC2 mentioned previously. The cartridge-related process module 52 also receives enable signals EN from the control circuit 48 via the enable signal line LE. The cartridge-related process module 52 also receives sensor driving signals DS from the driving signal generating circuit 42. The cartridge-related process module 52 presents the junction circuit 55 with a switching signal SEL for switching the state of the junction circuit 55. The switching signal SEL is a signal whose level changes depending on the enable signal EN; specifically, it is an inverted signal of the enable signal EN. More specifically, when the received enable signal is H (High) level, the cartridge-related process module 52 will output an L level switching signal SEL, and when the received enable signal is L (Low) level, the cartridge-related process module 52 will output an H level switching signal SEL. When the switching signal SEL is H level (i.e. at power supply potential VDD and CVDD, e.g. 3.3 V), the junction circuit 55 will assume a different state than it does at L level (ground level). The specific process content of the cartridge-related process module 52 will be discussed later.

The detection module 53 is connected to the first short detection line LCOA and the second short detection line LCOB, and receives detection signals COA and COB that appear on the first and second short detection lines LCOA, LCOB. The first and second short detection lines LCOA, LCOB are connected to the power supply potential VDD via pullup resistors (not shown); the first short detection terminal 210 (FIG. 2) is shorted with the ground terminal 220 in the circuit board 120 of the ink cartridge 100 as described earlier. For this reason, if each of the ink cartridges 100 is not installed in the holder 62, the detection module 53 will receive an H level detection signal COA via the first short detection line LCOA. If on the other hand each of the ink cartridges 100 is installed in the holder 62, the detection module 53 will receive an L level detection signal COA via the first short detection line LCOA. While its circuitry is not illustrated in detail, the detection module 53 will send the L level detection signal COA that it has received from each of the ink cartridges 100 to the main controller 40. Thus, the main controller 40 will be able to decide whether each of the cartridges 100 has been installed in the cartridge installation section.

As depicted in FIG. 2, the first short detection terminal 210 is situated in proximity to the first sensor driving terminal 250, to which the relatively high voltage (36 V maximum) sensor driving signal DS is applied. For this reason, if the first sensor driving terminal 250 and the first short detection terminal 210 should short, for example due to an adhering drop of conductive ink or a drop of condensed water, the 36 V maximum voltage will be applied to the first short detection terminal 210. Such voltage misapplication through the agency of a foreign substance will appear as a high level detection signal COA on the first short detection line LCOA which is connected to the first short detection terminal 210. If the detection module 53 detects that the potential level of the detection signal COA exceeds a prescribed threshold value, e.g. 6.0 V, it will bring an abnormality detection signal AB to H level. Normally, the detection module 53 sets the abnormality detection signal AB to L level. The abnormality detection signal AB will be presented by the detection module 53 to the junction circuit 55 and to the cartridge-related process module 52. the second short detection terminal 240 is situated in proximity to the second sensor driving terminal 290. Therefore, in a same way as first short detection terminal 210 described above, when the high voltage is misapplied to the second short detection terminal 240 and the potential level of the detection signal COB exceeds a prescribed threshold value, the detection module 53 bring the abnormality detection signal AB to H level.

Figure 7:
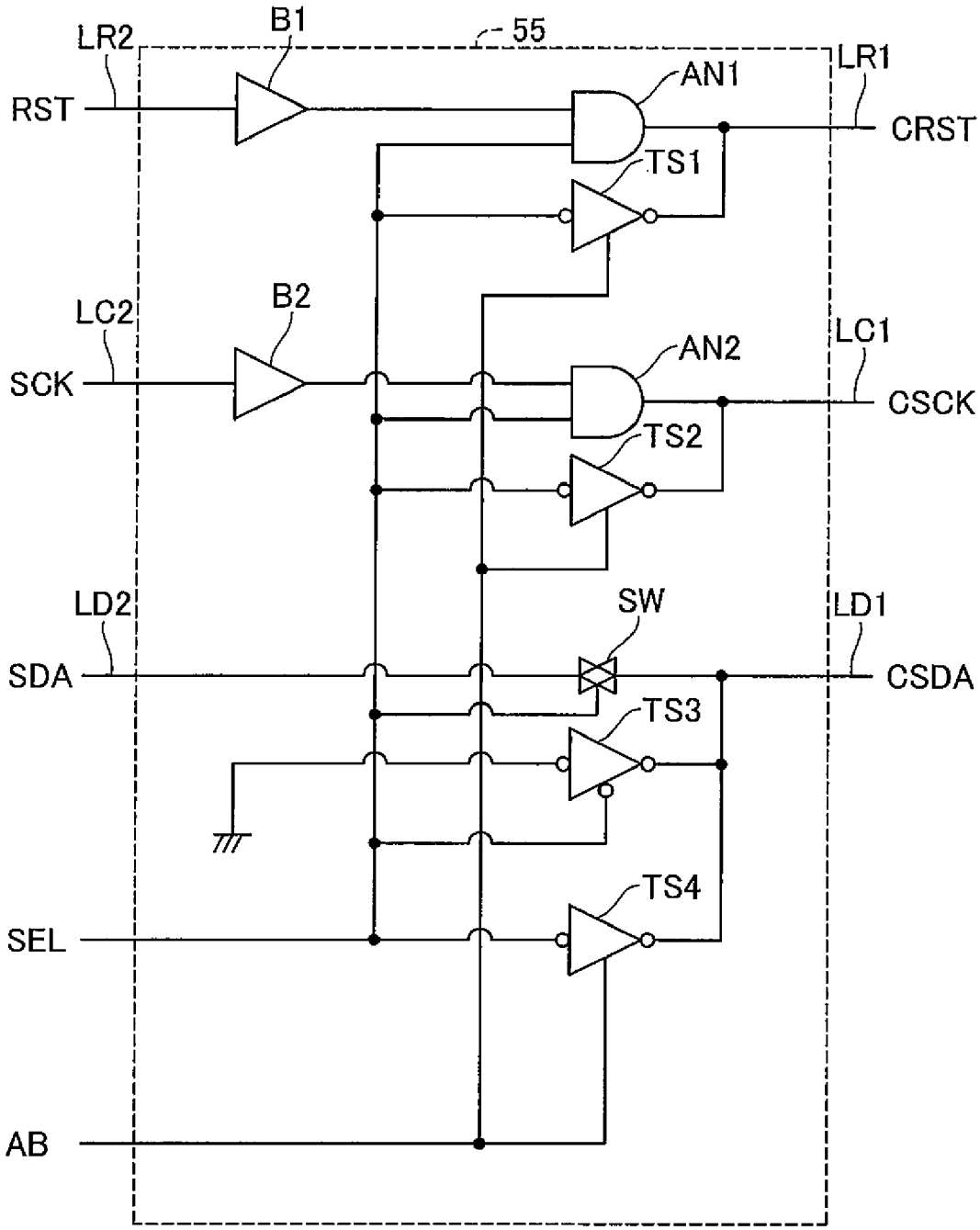
FIG. 7 is an illustration depicting the internal configuration of the junction circuit.

FIG. 7 is an illustration depicting the internal configuration of the junction circuit 55. The junction circuit 55 includes first and second buffer circuits B1, B2, first and second AND circuits AN1, AN2, an analog switch SW, and first to fourth three-state buffers TS1 to TS4.

The input terminal of the first buffer circuit B1 is connected to the second reset signal line LR2, and inputs the second reset signal RST from the control circuit 48 of the main controller 40. The output of the first buffer circuit B1 is input to the first input terminal of the first AND circuit AN1. The switching signal SEL output from the aforementioned cartridge-related process module 52 is input to the second input terminal of the first AND circuit AN1. The output terminal of the first AND circuit AN1 is connected to the first reset signal line LR1. That is, the output signal of the first AND circuit AN1 constitutes the first reset signal CRST that is presented to the ink cartridge 100. The switching signal SEL is also input to the input terminal of the first three-state buffer TS1. The output terminal of the first three-state buffer TS1 is connected to the first reset signal line LR1. The abnormality detection signal AB that is output from the detection module 53 discussed earlier is input to the control terminal of the first three-state buffer TS1. In the event that an L level signal is input to the control terminal of the first three-state buffer TS1, the output terminal of the first three-state buffer TS1 will assume high impedance and disconnect from the first reset signal line LR1. On the other hand, in the event that an H level signal is input to the control terminal of the first three-state buffer TS1, a signal of the same level as that at the input terminal will be output from the output terminal of the first three-state buffer TS1.

The input terminal of the second buffer circuit B2 is connected to the second clock signal line LC2, and inputs the second clock signal SCK from the control circuit 48 of the main controller 40. The output of the second buffer circuit B2 is input to the first input terminal of the second AND circuit AN2. The switching signal SEL is input to the second input terminal of the second AND circuit AN2. The output terminal of the second AND circuit AN2 is connected to the first clock signal line LC1. That is, the output signal of the second AND circuit AN2 constitutes the first clock signal CSCK that is presented to the ink cartridge 100. The switching signal SEL is also input to the input terminal of the second three-state buffer TS2. The output terminal of the second three-state buffer TS2 is connected to the first clock signal line LC1. The abnormality detection signal AB is input to the control terminal of the second three-state buffer TS2. The operation of the second three-state buffer TS2 is analogous to that of the first three-state buffer TS1 described above: where an L level signal is input to the control terminal, the output terminal of the second three-state buffer TS2 will assume high impedance and disconnect from the first clock signal line LC1. On the other hand, in the event that an H level signal is input to the control terminal of the second three-state buffer TS2, a signal of the same level as that at the input terminal will be output from the output terminal of the second three-state buffer TS2.

The second data signal line LD2 and the first data signal line LD1 are connected by the analog switch SW. The analog switch SW could be composed of a transmission gate, for example. The analog switch SW is controlled by the switching signal SEL. The analog switch SW will assume the electrically continuous (connected) state when the switching signal SEL is H level, and will assume the electrically discontinuous (disconnected) state when the switching signal SEL is L level.

The input terminal of the third three-state buffer TS3 is connected to the ground potential VSS, and the normal input is L level. The output terminal of the third three-state buffer TS3 is connected to the first data signal line LD1. An inverted signal of the switching signal SEL is input to the control terminal of the third three-state buffer TS3. Where an L level signal is input to the control terminal of the third three-state buffer TS3, a signal of the same level as that at the input terminal, i.e. an L level signal, will be output from the output terminal of the third three-state buffer TS3. On the other hand, where an H level signal is input to the control terminal of the third three-state buffer TS3, the output terminal of the third three-state buffer TS3 will assume high impedance and will disconnect from the first data signal line LD1.

The switching signal SEL is also input to the input terminal of the fourth three-state buffer TS4. The output terminal of the fourth three-state buffer TS4 is connected to the first data signal line LD1. The abnormality detection signal AB is input to the control terminal of the fourth three-state buffer TS4. The operation of the fourth three-state buffer TS4 is analogous to that of the first and second three-state buffers TS1, TS2 described above: where an L level signal is input to the control terminal, the output terminal of the fourth three-state buffer TS4 will assume high impedance and disconnect from the first data signal line LD1. Then, in the event that an H level signal is input to the control terminal of the fourth three-state buffer TS4, a signal of the same level as that at the input terminal will be output from the output terminal of the fourth three-state buffer TS4.

Determination of Remaining Ink Level:

In the first embodiment, the main controller 40 and the cartridge-related process module 52 of the sub-controller 50 cooperate to decide the level of remaining ink in the ink cartridges 100. This process (remaining ink level determination process) will be described below.

Figure 8:
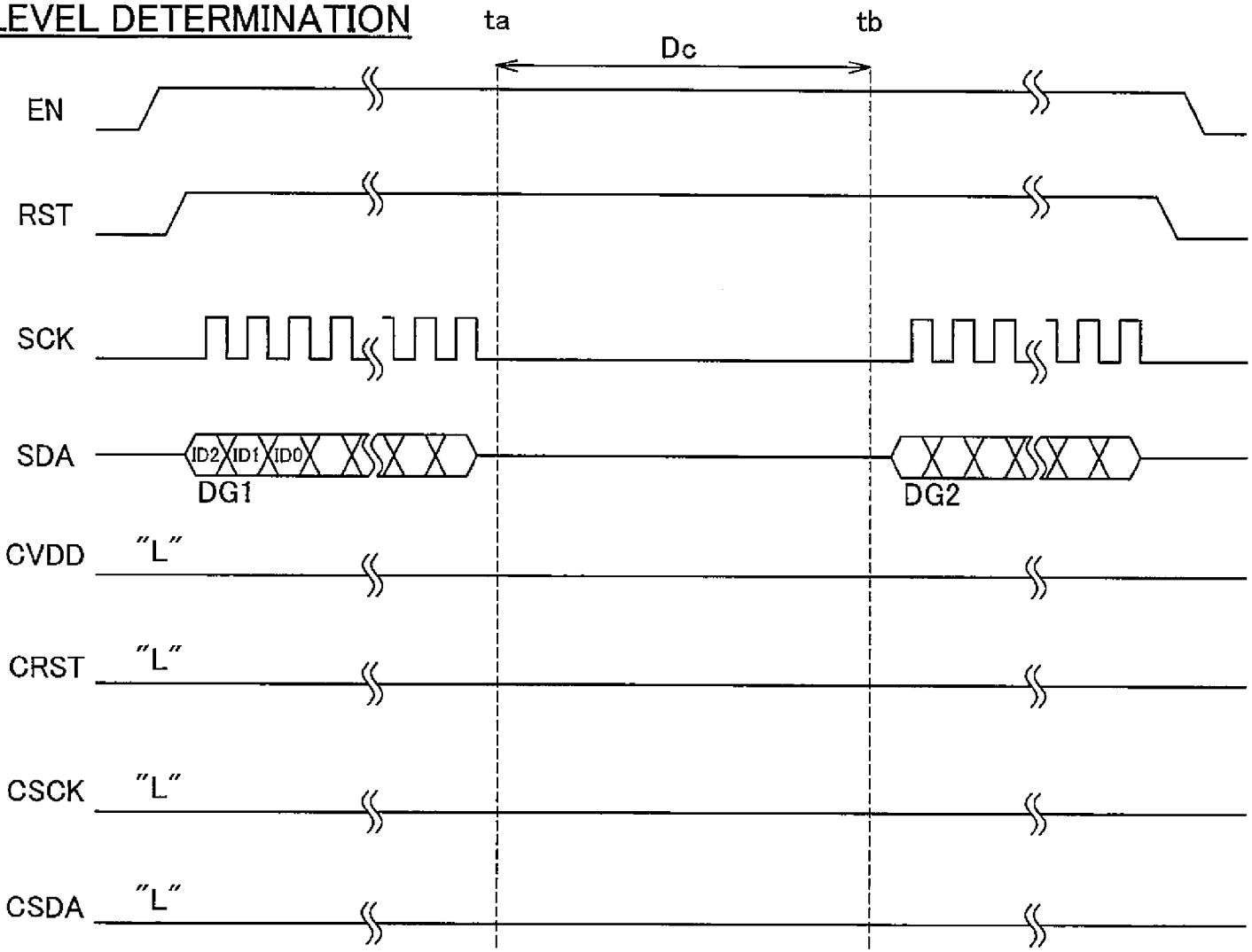
FIG. 8 is a timing chart explaining the remaining ink level determination process.

FIG. 8 is a timing chart explaining the remaining ink level determination process. FIG. 8 depicts the eight signals that were shown in FIGS. 5 to 7, namely, the enable signal EN, the second reset signal RST, the second clock signal SCK, the second data signal SDA, the power supply potential CVDD, the first reset signal CRST, the first clock signal CSCK, and the first data signal CSDA.

FIG. 9 is a conceptual depiction of the content of data sequences used during the remaining ink level determination process. As illustrated, the data sequences that are used during the remaining ink level determination process are composed of 20-bit data. During the remaining ink level determination process, the second data signal SDA which appears on the second data signal line LD2 will represent a data sequence group that includes a plurality of these data sequences.

Figure 9A:
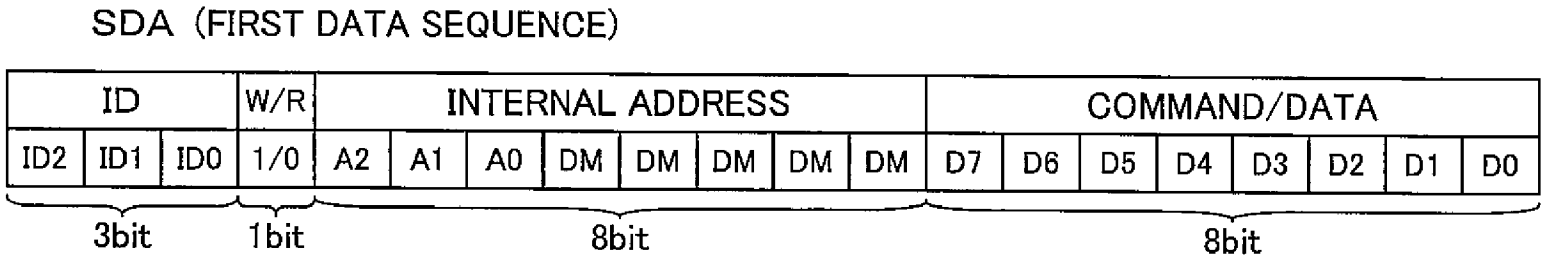
FIGS. 9A-B are conceptual depictions of the content of data sequences used during the remaining ink level determination process.

FIG. 9A depicts the data sequence from the group of data sequences that is the first to appear on the second data signal line LD2. As illustrated, the data sequence includes an ID segment (identification segment), a W/R segment (switching command segment), an internal address segment, and a command/data segment. The ID segment, the W/R segment, and the internal address segment are data elements that are output from the main controller 40, while the command/data segment is a data element that is output by either the main controller 40 or the sub-controller 50.

The ID segment is composed of 3-bit ID data (identification data) ID2-ID0, and indicates the ID number of the destination device of the data sequence group in question. The W/R segment is composed of a 1-bit switching command, and is utilized for the purpose of switching the input/output status of the input/output circuit of the destination device for the data sequence group, i.e. the direction of transmission of the command/data that makes up the command/data segment. For example, where the main controller 40 is to supply the cartridge-related process module 52 of the sub-controller 50 with a command/data, the W/R segment will be set to "W," i.e. 1 (H level), and the input/output circuit within the cartridge-related process module 52 will be set to the input-enabled state. On the other hand, if the main controller 40 is to receive data from the cartridge-related process module 52, the W/R segment will be set to "R," i.e. to 0 (L level), and the input/output circuit within the cartridge-related process module 52 will be set to the output-enabled state. The internal address segment is composed of 8-bit address data, and indicates the address of a register set contained in the internal register circuit of the cartridge-related process module 52, for example. In this embodiment, however, only three of the eight available bits are used. The other five bits can be data having arbitrary level (dummy data). The command/data segment is composed of 8-bit command/data. If the W/R segment is "W" (1), the command/data segment will contain command/data to be saved to the register circuit of the cartridge-related process module 52; whereas if the W/R segment is "R" (0), the command/data segment will contain data read from the register circuit of the cartridge-related process module 52.

Figure 9B:
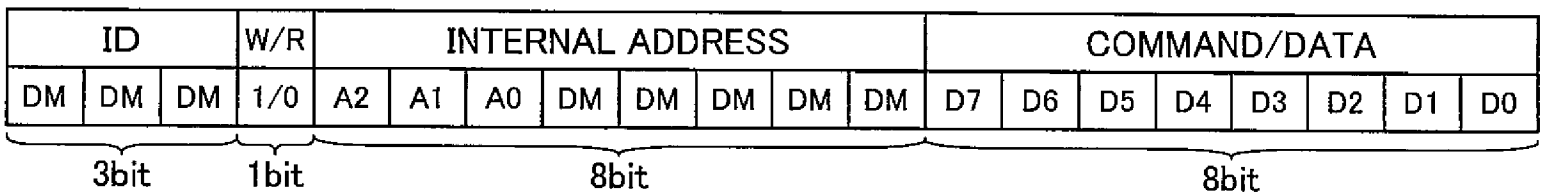

FIG. 9B depicts the data sequence from the group of data sequences that appears the second and subsequent times on the second data signal line LD2. As will be appreciated from a comparison of FIGS. 9A and B, the ID segment is different. Specifically, whereas in the first data sequence shown in FIG. 9A, the ID segment contains unique ID data, the ID segment in the second and subsequent data sequences shown in FIG. 9B contains dummy data. This is because the second and subsequent data sequences will be exchanged between the same devices as the first data sequence. Of course, it would be acceptable for the ID segment in the second and subsequent data sequences to include ID data identical to the ID segment in the first data sequence.

Once the remaining ink level determination process is initiated, the remaining ink level determining module M1 will change the enable signal which appears on the enable signal line LE from L level to H level. The remaining ink level determining module M1 will then cancel the second reset signal RST which appears on the second data signal line LD2. Specifically, the remaining ink level determining module M1 will change the second reset signal RST from L level to H level.

After changing the second reset signal RST to H level, the remaining ink level determining module M1 will now output the second clock signal SCK over the second clock signal line LC2, and will output the second data signal SDA over the second data signal line SDA. The second clock signal line LC2 and the second data signal SDA are in sync. In FIG. 8, up to a point in time ta, a first data sequence group DG1 will be output as the second data signal SDA on the second data signal line LD2.

As noted, the ID segment of the first data sequence included in the first data sequence group DG1 contains ID data ID2-ID0 (specifically, ID data to specify the sub-controller 50 "0, 0, 0") for selecting the cartridge-related process module 52 of the sub-controller 50 as the destination for the first data sequence group DG1. The cartridge-related process module 52 (FIG. 6) connected to the second data signal line LD2 will decide whether the ID data ID2-ID0 provided to it matches its own ID number (ID number of the sub-controller 50); in this case, it will decide that they match. The W/R segment of each data sequence is set to "W" (1). The cartridge-related process module 52 will therefore save the command that is contained in the command/data segment of each data sequence to the register group that is specified by the internal address segment of each data sequence. The command/data segment may contain, for example, a command requesting frequency measurement for the purpose of determining the remaining ink level (discussed later), or data identifying a particular ink cartridge 100 targeted for the frequency measurement.

Coincident with the timing at which reception of the first data sequence group DG1 is finished (specifically, at time ta in FIG. 8), the cartridge-related process module 52 will initiate a frequency measurement process. According to the data of the command/data segment that was contained in the first data sequence group DG1, the cartridge-related process module 52 will connect either to the first sensor driving signal line LDSN or to the second sensor driving signal line LDSP of the ink cartridge 100 that has been targeted for frequency measurement, to the third sensor driving signal line LDS. Coincident with the timing at which this connection is complete, the remaining ink level determining module M1 will control the driving signal generating circuit 42 and issue a sensor driving signal DS over the third sensor driving signal line LDS. As a result, the sensor driving signal DS will be applied to the piezoelectric element of the sensor 110 of the ink cartridge 100 that has been targeted for frequency measurement.

When the sensor driving signal DS is applied to the piezoelectric element of the sensor 110, strain (expansion and contraction) will be produced in the piezoelectric element. Coincident with the timing at which application of the sensor driving signal DS (trapezoidal pulse) ends, the cartridge-related process module 52 will disconnect the third sensor driving signal line LDS from the first sensor driving signal line LDSN or the second sensor driving signal line LDSP to which the third sensor driving signal line LDS was previously connected. By so doing, the piezoelectric element will oscillate (expand and contract) according to the remaining ink level, and the piezoelectric element will output a voltage that is dependent on the oscillation (a response signal RS) over the first sensor driving signal line LDSN or the second sensor driving signal line LDSP. The cartridge-related process module 52 will then measure the frequency of the response signal RS.

Coincident with the timing at which the cartridge-related process module 52 completes measurement of the frequency of the response signal RS (specifically, at a time tb that follows the time ta by a prescribed interval Dc), the remaining ink level determining module M1 will again output the second clock signal SCK over the second clock signal line LC2. Further, the remaining ink level determining module M1 will simultaneously exchange the second data signal SDA with the cartridge-related process module 52, via the second data signal line LD2. In FIG. 8, subsequent to time tb, the second data sequence group DG2 will be exchanged between the main controller 40 and the cartridge-related process module 52.

While the second data sequence group DG2 includes a plurality of data sequences, since the second data sequence group DG2 includes only the second and subsequent data sequences, the ID segment of each data sequence will contain dummy data. The W/R segment of each data sequence will be set to "R" (0). For this reason, the cartridge-related process module 52 will read the data from the register group that is specified by the internal address segment of each data sequence, and supply a command/data segment containing the read data to the main controller 40. The command/data segment may include a frequency measurement result (data).

After exchanging the second data sequence group DG2 with the cartridge-related process module 52, the remaining ink level determining module M1 will halt output of the second clock signal SCK, and will change the second reset signal RST from H level to L level. The remaining ink level determining module M1 will additionally change the enable signal EN from H level to L level.

On the basis of result of frequency measurement received from the cartridge-related process module 52, the remaining ink level determining module M1 will determine the remaining ink level for the ink cartridge 100 that was targeted for the process. For example, if the remaining ink level is equal to or greater than a prescribed level, the piezoelectric element will oscillate at a first characteristic frequency H1 (e.g. approximately 30 KHz), whereas if the remaining ink level is less than the prescribed level, the piezoelectric element will oscillate at a second characteristic frequency H2 (e.g. approximately 110 KHz). In this case, if the received result of frequency measurement is substantially equal to the first characteristic frequency H1, the remaining ink level determining module M1 will decide that the remaining ink level is equal to or greater than the prescribed level; or if it is substantially equal to the second characteristic frequency H2, it will decide that the remaining ink level is less than the prescribed level.

During the remaining ink level determination process described above, the main controller 40 will not output the 3.3 V power supply over the first power supply line LCV, and will bring the potential CVDD on the first power supply line LCV to L level (FIG. 8). Power consumption by the printer 20 is reduced thereby.

Here, during the remaining ink level determination process, since the enable signal EN is brought to H level, the cartridge-related process module 52 will output an L level switching signal SEL as described above. It will be appreciated that, as a result, during the remaining ink level determination process the output of the first AND circuit AN1 will go to L level within the junction circuit 55 as depicted in FIG. 7. It will be appreciated that during the remaining ink level determination process, the output of the second AND circuit AN1 will similarly go to L level within the junction circuit 55. It will furthermore be appreciated that during the remaining ink level determination process, within the junction circuit 55, the analog switch SW will go to the OFF state and L level will be output from the output terminal of the third three-state buffer TS3.

Consequently, during the remaining ink level determination process, the three lines that interconnect the sub-controller 50 and the memory devices 130 of the ink cartridges 100, i.e. the first reset signal line LR1, the first clock signal line LC1, and the first data signal line LD1, will be respectively disconnected so that signals are no longer transmitted over the second reset signal line LR2, the second clock signal line LC2, and the second data signal line LD2 that respectively interconnect the main controller 40 and the sub-controller 50. Potential on the first reset signal line LR1, the first clock signal line LC1, and the first data signal line LD1 will then respectively go to L level (ground level). That is, during the remaining ink level determination process, the first reset signal line LR1, the first clock signal line LC1, and the first data signal line LD1 will be connected to ground potential VSS.

As will be understood from the above description, in the first embodiment, the first and second AND circuits AN1, AN2 and the third three-state buffer TS3 correspond to the first driver in the present invention. The junction circuit 55 in the first embodiment corresponds to the connecting module in the present invention.

Detection of Misapplied Voltage

During the remaining ink level determination process, the sensor driving signal DS (which includes voltage of 36 V) will appear on either the first sensor driving signal line LDSN or the second sensor driving signal line LDSP, and thus as mentioned above, the detection module 53 may sometimes detect misapplied voltage so that the detection module 53 outputs an H level abnormality detection signal AB.

During the remaining ink level determination process, if misapplied voltage is detected and the abnormality detection signal AB rises from L level to H level, then the output terminals of three of the three-state buffers, i.e. the first three-state buffer TS1, the second three-state buffer TS2, and the fourth three-state buffer TS4, will change from a state of high impedance to L level as depicted in FIG. 7. At this point, the first three-state buffer TS1 will function as an electric current supply bringing the potential on the first reset signal line LR1 to L level (ground level). Similarly, the second three-state buffer TS2 will function as an electric current supply bringing the potential on the first clock signal line LC1 to L level. The third three-state buffer TS3 will function as an electric current supply bringing the potential on the first data signal line LD1 to L level.

It will be appreciated from the above description that in the first embodiment, the first and second three-state buffers TS1, TS2 and the fourth three-state buffer TS4 correspond to the second driver in the present invention.

Access to Memory Devices:

In the first embodiment, the memory access module M2 of the main controller 40 accesses the memory devices 130 of the ink cartridges 100 via the junction circuit 55 of the sub-controller 50. This process (memory device access process) will be described below.

Figure 10:
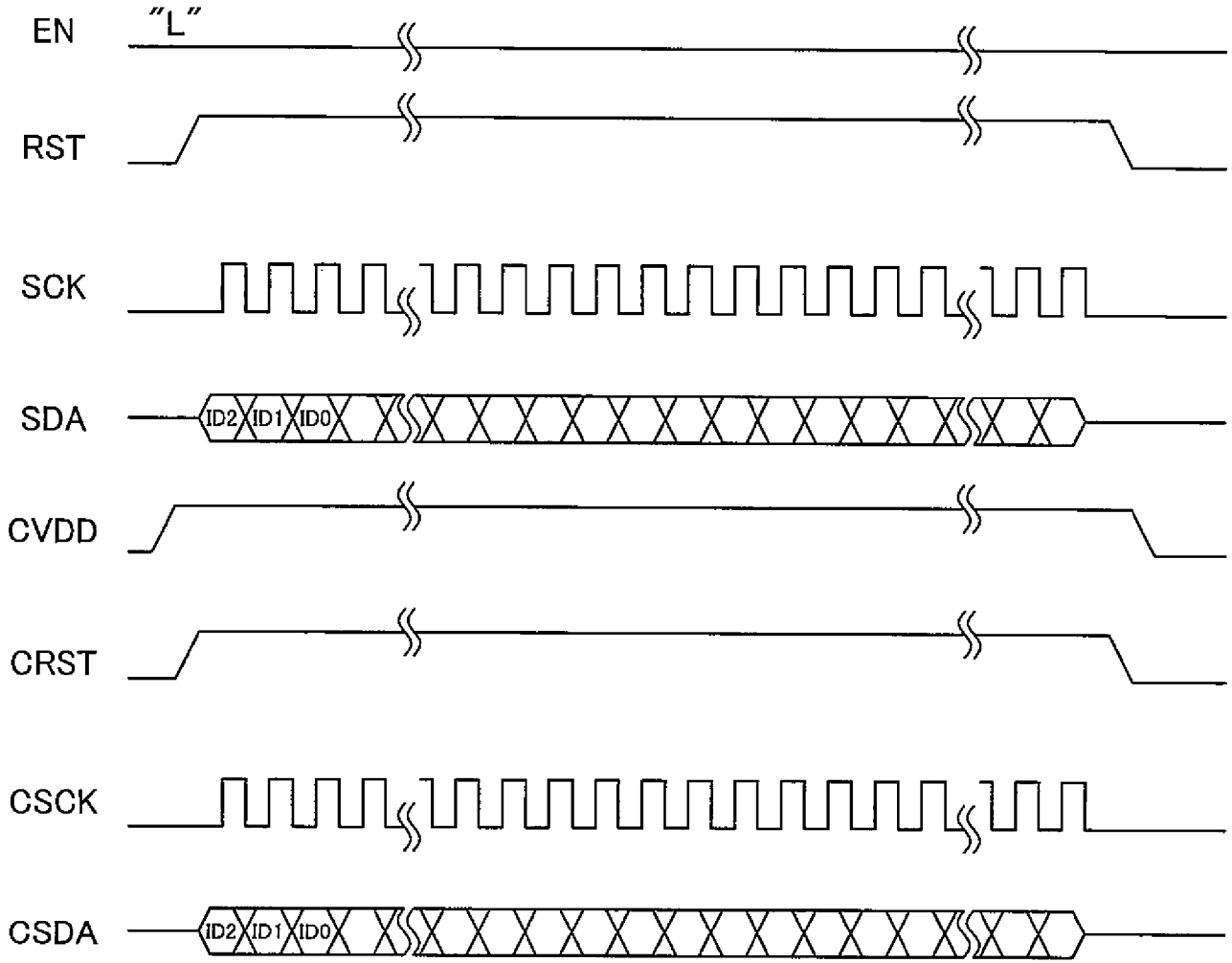
FIG. 10 is a timing chart illustrating the memory device access process.
Figure 11:
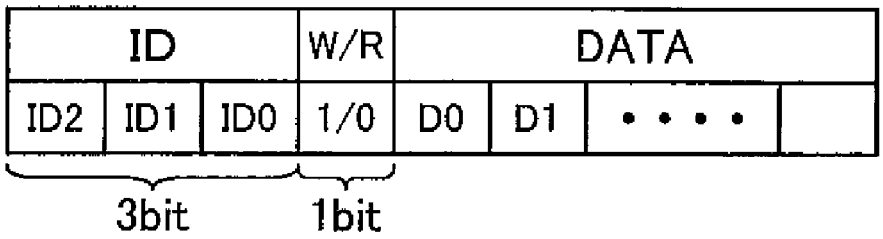
FIG. 11 is a conceptual depiction of the content of the data sequence used during the memory device access process.

FIG. 10 is a timing chart illustrating the memory device access process. In FIG. 10, eight signals comparable to those in FIG. 8 are depicted. FIG. 11 is a conceptual depiction of the content of the data sequence used during the memory device access process. As illustrated, the data sequence used in the memory device access process includes an ID segment (identification segment), a W/R segment (switching command segment), and a data segment. The ID segment and the W/R segment are data elements that are output from the memory access module M2 of the main controller 40, while the data segment is a data element that is output by either the memory access module M2 or the memory device 130.

The ID segment is composed of 3-bit ID data ID2-ID0, and indicates the ID number of the device controlled by the memory access module M2 (specifically, the ID number "0, 0, 1"-"1, 1, 0" of the memory device 130). The W/R segment is composed of a 1-bit switching command, and is utilized for the purpose of switching the input/output status of the input/output circuit of the memory device 130, i.e. the direction of transmission-of the data making up the data segment. If the memory access module M2 is to supply data to the memory device 130, the W/R segment will be set to "W," i.e. 1 (H level), and the input/output circuit within the memory device 130 will be set to the input-enabled state. On the other hand, if the memory access module M2 is to receive data from the memory device 130, the W/R segment will be set to "R," i.e. to 0 (L level), and the input/output circuit within the memory device 130 will be set to the output-enabled state. The data segment is composed of 1-bit or multiple-bit data. If the W/R segment is "W" (1), this indicates that the data segment contains data to be written to the memory cell array in the memory device 130, whereas if the W/R segment is "R" (0), this indicates that the data segment contains data that has been read from the memory cell array in the memory device 130.

In this embodiment, nonvolatile memory (e.g. EEPROM) that is accessed sequentially on an individual memory cell basis is employed as the memory cell array. If the W/R segment is "W" (1), the memory device 130 will successively select one memory cell at a time within the memory cell array in sync with the first clock signal CSCK, and will sequentially write 1-bit data to the selected memory cell. If the W/R segment is "R" (0), the memory device 130 will successively select one memory cell at a time within the memory cell array in sync with the first clock signal CSCK, and will sequentially read 1-bit data from the selected memory cell.

Once the memory device access process is initiated, the memory access module M2 of the main controller 40 will bring the power supply potential CVDD of the first power supply line LCV to H level. Specifically, it will supply power from the power supply (in this embodiment, 3.3 V) to the memory device 130 of each of the ink cartridges 100. The memory access module M2 will then cancel the second reset signal RST which appears on the second data signal line LD2. Specifically, the remaining ink level determining module M1 will change the second reset signal RST from L level to H level.

After changing the second reset signal RST to H level, the memory access module M2 will now output the second clock signal SCK over the second clock signal line LC2, and will output the second data signal SDA (which represents the data sequence shown in FIG. 11) over the second data signal line SDA.

Here, the enable signal EN will be maintained at L level during the course of the memory device access process. Thus, the cartridge-related process module 52 will output a high level switching signal SEL. As a result, at times of memory device access, a signal having the same level as the level of the second reset signal line LR2 will be output from the output terminal of the first AND circuit AN1 within the junction circuit 55, as depicted in FIG. 7. As a result, a signal that is identical to the signal appearing on the second reset signal line LR2 will appear on the first reset signal line LR1 that is connected to the output terminal of the first AND circuit AN1. Consequently, as shown in FIG. 10, the first reset signal CRST which is supplied to the memory device 130 will be an identical signal to the second reset signal RST. Similarly, at times of memory device access, a signal having the same level as the level of the second clock signal line LC2 will be output from the output terminal of the second AND circuit AN2 within the junction circuit 55 as depicted in FIG. 10. Consequently, as shown in FIG. 10, the first clock signal CSCK which is supplied to the memory device 130 will be an identical signal to the second clock signal SCK. Moreover, at times of memory device access, within the junction circuit 55 the analog switch will be placed in the ON state, electrically connecting the second data signal line LD2 with the first data signal line LD1. Also, the output terminal of the fourth three-state buffer TS4 will assume a high impedance state. Consequently, as shown in FIG. 10, the first data signal CDSA supplied to the memory device 130 will be an identical signal to the second data signal SDA. It will be appreciated from the above description that during the memory device access process, the first reset signal line LR1 and the second reset signal line LR2 will be connected via the junction circuit 55 so as to enable communication of reset signals between the main controller 40 and the memory devices 130. Also, during the memory device access process, the first clock signal line LC1 and the second clock signal line LC2 will be connected via the junction circuit 55 so as to enable communication of clock signals between the main controller 40 and the memory devices 130. Furthermore, during the memory device access process, the first data signal line LD1 and the second data signal line LD2 will be connected via the junction circuit 55 so as to enable communication of data signals between the main controller 40 and the memory devices 130.

During memory device access, the abnormality detection signal AB is always at L level, and thus in the first three-state buffer TS1, the second three-state buffer TS2, and the fourth three-state buffer TS4, the output terminal will assume a high impedance state, thus disconnecting them from the first reset signal line LR1, the first clock signal line LC1, and the first data signal line LD1, respectively.

As will be appreciated from the above description, at times of memory device access, the first reset signal CRST, the first clock signal CSCK, and the first data signal CSDA received at the memory devices 130 will be signals that are substantially identical to the second reset signal RST, the second clock signal SCK, and the second data signal SDA output by the memory access module M2.

The data sequence shown in FIG. 11 is received as the first data signal CSDA by each of the memory devices 130. The ID segment of the data sequence contains ID data ID2-ID0 (e.g. "0, 0, 1") for selecting one memory device 130*a* as the target for control. Each of the memory devices 130 will decide whether the ID data ID2-ID0 provided to it matches its own ID number. The memory device selected as the target for control (target memory device) 130*a* will then execute a process according to the received data sequence. Specifically, if the W/R segment is "W" (1), the target memory device 130*a* will save to the memory cell array the contents of the data segment included in the data sequence that was received from the main controller 40. If the W/R segment is "R" (0), the target memory device 130*a* will read data from the memory cell array and will output a data segment containing the data over the first data signal line LD1. The output data segment will be received by the memory access module M2 of the main controller 40 via the first data signal line LD1, the analog switch SW, and the second data signal line LD2. Memory devices not selected as the control target will go into standby mode.

After the data sequence shown in FIG. 11 has been exchanged between the memory access module M2 and the target memory device 130*a* in this way, the memory access module M2 will halt output of the second clock signal SCK, and will change the second reset signal RST from H level to L level. The memory access module M2 will additionally change the power supply potential CVDD output over the first power supply line LCV from H level to L level, and terminate the process.

According to the first embodiment described above, the lines for accessing the memory device 130 from the main controller 40 are divided by junction circuit 55 of the sub-controller 50 into a second line group (the second reset signal line LR2, the second clock signal line LC2, and the second data signal line LD2) and a first line group (the first reset signal line LR1, the first clock signal line LC1, and the first data signal line LD1). For this reason, in the event that voltage is mistakenly applied to the first line group (which is directly connected to the memory device 130) the effects of the misapplied voltage on the main controller 40 and on the cartridge-related process module 52 of the sub-controller 50 may be reduced. Possible effects of misapplied voltage on the main controller 40 and the cartridge-related process module 52 may include damage to the main controller 40 or to the cartridge-related process module 52; or destabilized communication between the main controller 40 and the cartridge-related process module 52.

Such misapplied volt may include, for example, crosstalk noise of the sensor drive signal DS; a sensor drive signal DS misapplied to the connector terminals 67 of the printer 20 due to a drop of ink or condensation; or malfunction of the memory device 130. In particular, since the sensor drive signal DS includes voltage (in this embodiment, a maximum of 36 V) that is markedly higher than the driving voltage of the main controller 40 and the sub-controller 50 (in this embodiment, 3.3 V), the possible effects of misapplied voltage caused by the sensor drive signal DS are considerable. As noted, in the first embodiment, during remaining ink level determination, which involves generating the sensor drive signal DS, an L level switching signal SEL will be input to the junction circuit 55, thereby electrically isolating the first line group and the second line group. Meanwhile, the main controller 40 and the cartridge-related process module 52 are connected to the second line group. As a result, even if misapplied voltage caused by the sensor drive signal DS is applied to the first line group, the effects on the main controller 40 and the cartridge-related process module 52 may be reduced.

For example, with a typical bus configuration, devices such as the main controller 40, the cartridge-related process module 52, and the memory devices 130 will all be interconnected by a common line (a bus). With such a configuration, misapplied voltage applied to the bus in proximity to a memory device 130 poses a considerable risk of adverse effects on the main controller 40 or the cartridge-related process module 52. In the first embodiment, such effects may be reduced.

Furthermore, in the first embodiment, during the remaining ink level determination process, the first line group is connected to a fixed potential, namely, ground potential (L level). Thus, in the event that misapplied voltage is applied to the first line group during the remaining ink level determination process, the effects of the misapplied voltage on the main controller 40, the cartridge-related process module 52 and the memory device 130 may be further reduced.

Furthermore, in the first embodiment, in the event that misapplied voltage above a prescribed level is applied to the first short detection terminal 210 or second short detection terminal 240, and such misapplied voltage sensed by the detection module 53 during the remaining ink level determination process, the first line group will be driven to ground potential (L level) by the three-state buffers TS1, TS2, and TS4. Specifically, if misapplied voltage is sensed by the detection module 53, the capability to drive the first line group to ground potential (L level) will be enhanced. As a result, it will be possible to further reduce the effects of the misapplied voltage when misapplied voltage has been applied to the first line group.

B. Second Embodiment

Figure 12:
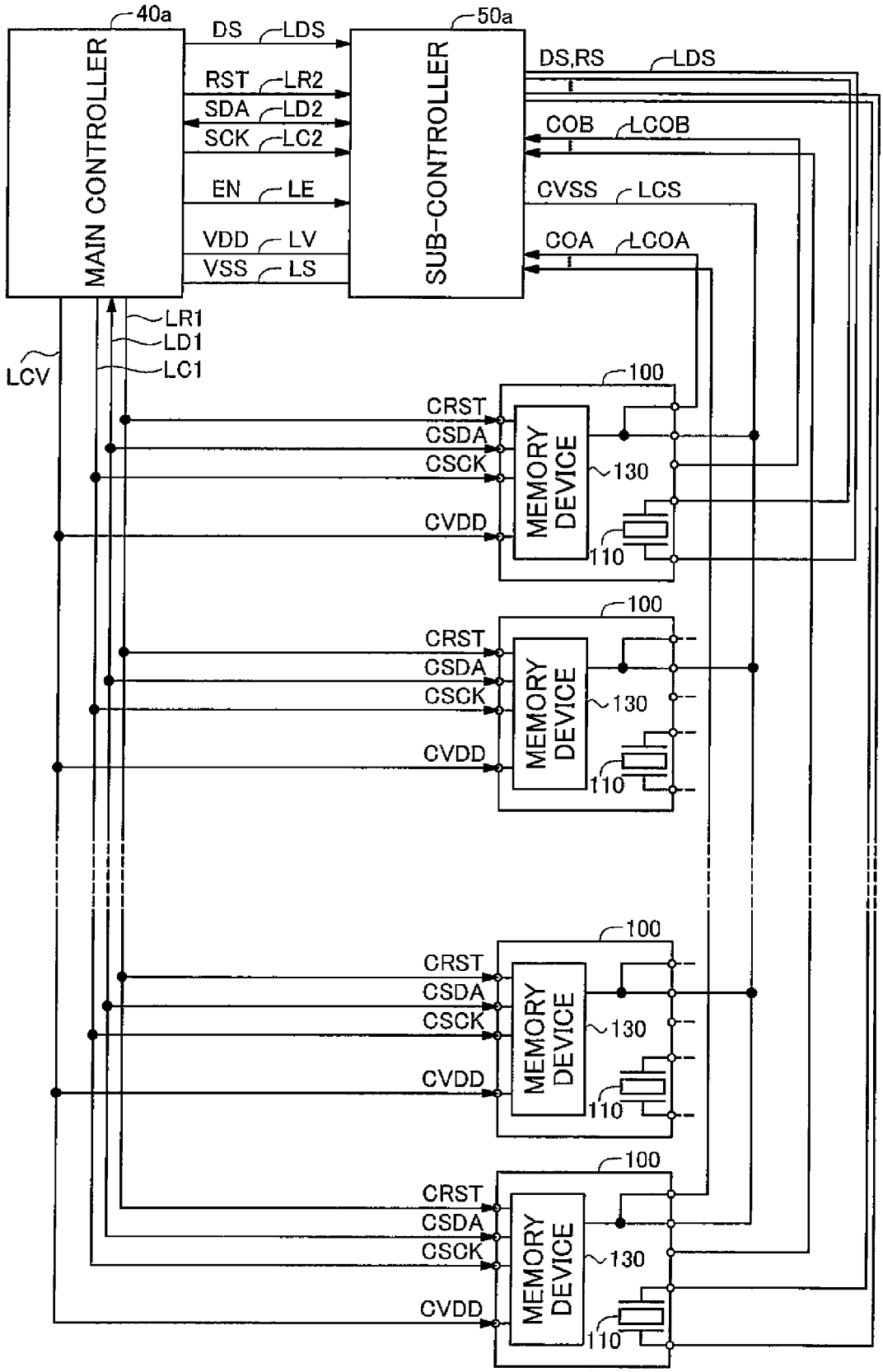
FIGS. 12 and 13 are diagrams showing the electrical configuration of a printer in the second embodiment.
Figure 13:
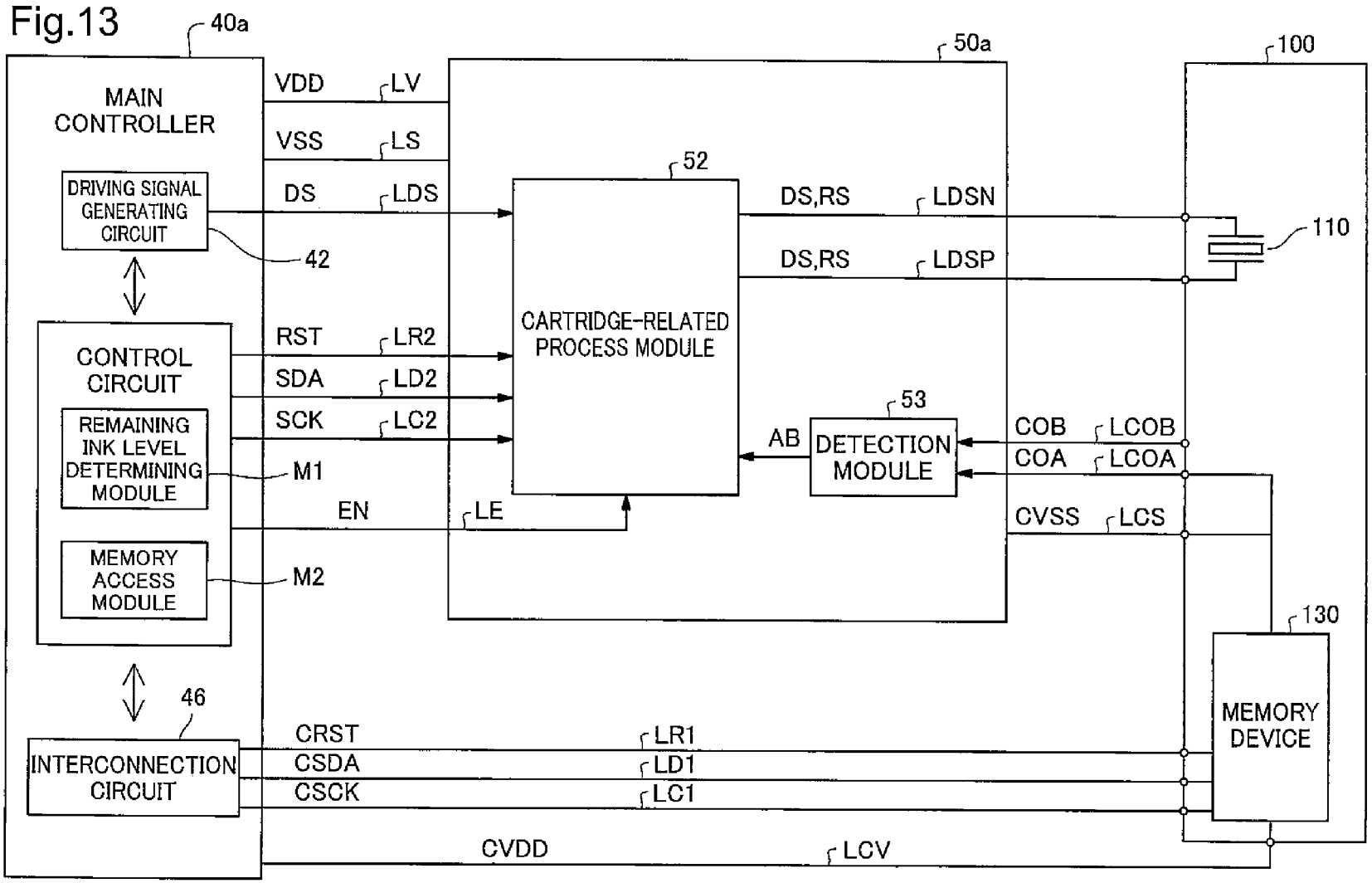
Figure 14:
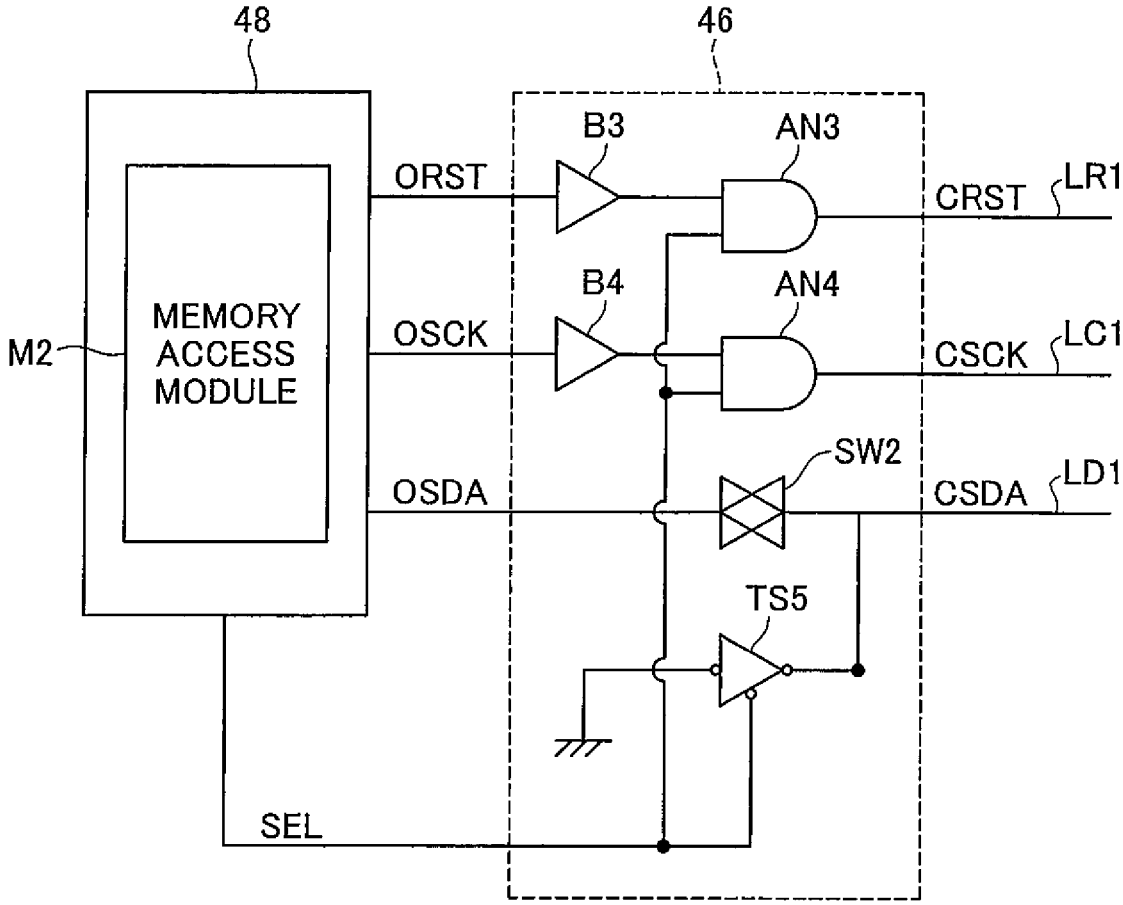
FIG. 14 is a diagram depicting the internal configuration of a interconnection circuit.

A second embodiment will now be described making reference to FIGS. 12 to 14. FIGS. 12 and 13 are diagrams showing the electrical configuration of a printer in the second embodiment. FIG. 14 is a diagram depicting the internal configuration of a interconnection circuit.

The printer in the second embodiment is provided with a main controller 40*a* in place of the main controller 40 of the printer 20 in the first embodiment. The printer in the second embodiment is also provided with a sub-controller 50*a* in place of the sub-controller 50 (carriage circuit) of the printer 20 in the first embodiment. The printer in the second embodiment differs from the first embodiment in terms of the connections of the first line group (the first reset signal line LR1, the first clock signal line LC1, and the first data signal line LD1). In other respects, the configuration of the second embodiment, i.e. the general configuration of the printer and the configuration of the ink cartridges 100, are the same as the configuration of the first embodiment described with reference to FIG. 1 to FIG. 4, and as such require no further description and will be assigned like symbols to first embodiment in the following discussion.

As depicted in FIG. 13, the main controller 40*a* of the second embodiment includes a interconnection circuit 46 in addition the configuration of the main controller 40 of the first embodiment. The sub-controller 50*a* of the second embodiment lacks the junction circuit 55 that was provided to the sub-controller 50 of the first embodiment.

As shown in FIG. 12 and FIG. 13, in the second embodiment, the first line group (the first reset signal line LR1, the first clock signal line LC1, and the first data signal line LD1) connects the main controller 40*a* with the ink cartridges 100. Specifically, the ends of the first line group on the main controller 40 side thereof connect to the interconnection circuit 46 of the main controller 40*a*. The ends of the first line group on the ink cartridge 100 side thereof connects via corresponding terminals to the memory device 130, in the same way as in the first embodiment.

In the first embodiment, during the memory device access process, the memory access module M2 uses the second line group (the second reset signal line LR2, the second clock signal line LC2, and the second data signal line LD2) to access the memory device 130 of each ink cartridge 100. In the second embodiment on the other hand, during the memory device access process, the memory access module M2 does not use the second line group, but rather uses only the first line group (the first reset signal line LR1, the first clock signal line LC1, and the first data signal line LD1) to access the memory device 130 of each ink cartridge 100. Specifically, as depicted in FIG. 14, the interconnection circuit 46 will exchange the first reset signal CRST, the first clock signal CSCK, and the first data signal CSDA with the interconnection circuit 46 via the first line group.

As shown in FIG. 14, the interconnection circuit 46 includes a third and a fourth buffer circuit B3, B4; a third and a fourth AND circuit AN3, AN4; a second analog switch SW2; and a fifth three-state buffer TS5.

An original signal ORST constituting a signal for output as the first reset signal CRST is input to the input terminal of the third buffer circuit B3 by the memory access module M2. The output of the third buffer circuit B3 is input to the first input terminal of the third AND circuit AN3. The switching signal SEL is input to the second input terminal of the third AND circuit AN3. In the second embodiment, the switching signal SEL is output from the memory access module M2. Specifically, during the memory access process, the memory access module M2 will output an H level switching signal SEL, and at other times (e.g. during the remaining ink level determination process) will output an L level switching signal SEL. The output terminal of the third AND circuit AN3 is connected to the first reset signal line LR1. That is, the output signal of the third AND circuit AN3 constitutes the first reset signal CRST that is supplied to the ink cartridges 100.

An original signal OCSK constituting a signal for output as the first clock signal CSCK is input to the input terminal of the fourth buffer circuit B4 by the memory access module M2. The output of the fourth buffer circuit B4 is input to the first input terminal of the fourth AND circuit AN4. The aforementioned switching signal SEL from the memory access module M2 is input to the second input terminal of the fourth AND circuit AN4. The output terminal of the fourth AND circuit AN4 is connected to the first clock signal line LC1. That is, the output signal of the fourth AND circuit AN4 constitutes the first clock signal CSCK that is supplied to the ink cartridges 100.

The first data signal line LD1 is connected by the second analog switch SW2 to the line over which an original signal OSDA constituting a signal for output as the first data signal CSDA is input from the memory access module M2. The second analog switch SW2 is composed of a transmission gate, for example. The analog switch SW2 is controlled by the switching signal SEL. The analog switch SW will assume the ON (connected) state when the switching signal SEL is H level, and will assume the OFF (disconnected) state when the switching signal SEL is L level.

The input terminal of the fifth three-state buffer TS5 is connected to the ground potential VSS, and the normal input is L level. The output terminal of the fifth three-state buffer TS5 is connected to the first data signal line LD1. An inverted signal of the switching signal SEL is input to the control terminal of the fifth three-state buffer TS5. Where an L level signal is input to the control terminal of the fifth three-state buffer TS5, a signal of the same level as that at the input terminal (i.e. an L level signal) will be output from the output terminal of the fifth three-state buffer TS5. On the other hand, where an H level signal is input to the control terminal of the fifth three-state buffer TSS, the output terminal of the fifth three-state buffer TS5 will assume high impedance and will disconnect from the first data signal line LD1.

Determination of Remaining Ink Level:

In the second embodiment, determination of the remaining ink level is carried out through cooperation of the remaining ink level determining module M1 of the main controller 40*a* and the cartridge-related process module 52 analogously to the first embodiment. At this time, the memory access module M2 will bring the switching signal SEL to L level. It will be appreciated that, as a result, during the remaining ink level determination process, within the interconnection circuit 46 depicted in FIG. 14 the output of the third AND circuit AN3 will go to L level. It will further be appreciated that during the remaining ink level determination process, within the interconnection circuit 46 the second analog switch SW2 will assume the OFF state and L level will be output from the output terminal of the fifth three-state buffer TS5.

In the second embodiment, the first line group and the second line group are separated rather than being connected. Then, in the remaining ink level determination process, potential on the first reset signal line LR1, the first clock signal line LC1, and the first data signal line LD1 will be respectively brought to L level (ground level).

As will be appreciated from the description above, the third and fourth AND circuits AN3, AN4 and the fifth three-state buffer TS5 in the second embodiment correspond to the first driver in the present invention. The interconnection circuit 46 in the second embodiment corresponds to the connecting module in the present invention.

Access to Memory Devices:

In the second embodiment, the memory access module M2 carries out exchange of the first reset signal CRST, the first clock signal CSCK, and the first data signal CSDA with the memory devices 130 via the interconnection circuit 46 and the first line group as described above. The content and timing of the exchanged signals is analogous to that in the memory device access process in the first embodiment. However, in the second embodiment, in contrast to the first embodiment, the second line group is not used during the memory device access process.

According to the second embodiment described above, the first line group and the second line group are electrically isolated. The main controller 40 and the cartridge-related process module 52 are connected to the second line group. As a result, in a manner analogous to the first embodiment, the effects on the main controller 40 and the cartridge-related process module 52 of misapplied voltage caused by the sensor driving signal DS and applied to the first line group may be reduced.

Furthermore, in the second embodiment, the first line group is connected to fixed potential, i.e. ground potential (L level) during the remaining ink level determination process. It is accordingly possible to further reduce the effects of misapplied voltage in the event that voltage is misapplied to the first line group during the remaining ink level determination process.

C. Variations

First Variation:

In the preceding embodiments, the sub-controller 50 (cartridge-related process module 52) is assigned an ID number, but the sub-controller need not be assigned an ID number. Specifically, in the embodiments described above, where the second data signal SDA is destined for the sub-controller 50, the enable signal EN will be set to H level. Thus, in the preceding embodiments, from the fact that the enable signal EN is at H level the cartridge-related process module 52 of the sub-controller 50 will be able to recognize that the second data signal SDA which has appeared on the second data signal line LD2 is data destined for itself (i.e. for the cartridge-related process module 52). For this reason, proper operation will be possible even in the absence of an ID number for the sub-controller 50.

Second Variation:

In the preceding embodiments, the process of measuring response signal frequency was described as the process carried out by the cartridge-related process module 52 of the sub-controller 50, but it would be possible to execute other processes as well. For example, the main controller could instruct the cartridge-related process module to sense the level of a cartridge output signal CO and to save the level in question to a register circuit within the cartridge-related process module. The main controller could then read the level of the cartridge output signal that has been stored in the register circuit, and decide whether each cartridge has been installed in the holder. Generally speaking, the cartridge-related process module may carry out any prescribed process in relation to the ink cartridges.

Third Variation:

In the preceding embodiments, the devices of the ink cartridges 100 that are connected via the first line group are memory devices 130; however, other devices could be employed instead of memory devices 130. For example, the device installed in the ink cartridges 100 could be a processor such as a CPU or ASIC, or a more basic IC.

Forth Variation:

In the preceding embodiments, during the remaining ink level determination process the first line group is connected to ground level; however, the connection is not limited to ground level, and could be any stable potential such as power supply level.

Fifth Variation:

In the preceding embodiments, the cartridges contain ink, but they could contain toner instead. In general, the printing device may employ any container that contains printing matter.

Sixth Variation:

While in the preceding embodiments, a printing device of ink-jet format was employed, it would be possible to employ a liquid jetting apparatus that jets or ejects a liquid other than ink. Herein, liquid is used in a broad sense to include liquids that contain particles of a functional material dispersed in a medium, or gel-like fluid bodies. For example, a liquid jetting apparatus for jetting a liquid containing in dispersion or solution form a material such as an electrode material or coloring matter used in manufacture of liquid crystal displays, EL (electroluminescence) displays, surface-emission displays, color filters or the like; a liquid jetting apparatus for jetting organic material used in manufacture of bio chips; or a liquid jetting apparatus for jetting liquid as specimens to be used as precision pipettes would be acceptable. Additionally, a liquid jetting apparatus for pinpoint application of lubricating oil in precision instruments such as timepieces or cameras; a liquid jetting apparatus for jetting a clear resin solution of an ultraviolet curing resin etc. to produce tiny semispherical lenses (optical lenses) for use as optical communications elements etc.; or a liquid jetting apparatus for jetting an etchant such as an acid or alkali in order to etch a substrate would be acceptable as well. The present invention may be embodied in any of the above types of jetting apparatus.

While the print control technology pertaining to the invention have been shown and described on the basis of the embodiments and variations, the embodiments of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A liquid jetting apparatus to which a liquid container is attached, the container containing a liquid and having a first device, the liquid jetting apparatus comprising:

a processor that executes a prescribed process in relation to the liquid container;

a first line for electrical connection to the first device;

a second line for electrical connection to the processor;

a controller that, in a first instance, accesses the first device via at least the first line and that, in a second instance, accesses the processor via the second line to have the processor execute the prescribed process; and a connecting module that, in the second instance, electrically sets the first line to a fixed voltage, wherein the first device includes a memory device, wherein the first line is between the connection module and the memory, wherein:

the liquid container further includes a second device, the liquid jetting apparatus further includes a third line for electrically connecting the controller and the second device, and the prescribed process includes application of driving voltage to the second device through the third line, wherein the driving voltage is higher than a voltage of a power supply potential of the memory as measured from a ground potential.

2. The liquid jetting apparatus according to claim 1, wherein the connecting module further includes a first driver that, in the second instance, brings the first line to a fixed voltage.

3. The liquid jetting apparatus according to claim 1, further comprising a detector capable of detecting if undesired voltage is applied to the first line due to the prescribed process, wherein the connecting module further includes a driver that brings the first line to a fixed voltage when the detector detects the undesired voltage.

4. The liquid jetting apparatus according to claim 3, wherein the undesired voltage due to the prescribed process is greater than a voltage of the first line without the undesired voltage.

5. The liquid jetting apparatus according to claim 1, further comprising:

a first terminal for electrically connecting the first device of the liquid container to the first line; and a second terminal for electrically connecting the second device of the liquid container to the third line;

wherein the first terminal and the second terminal are mutually closely situated.

6. The liquid jetting apparatus according to claim 1, wherein the second device includes a sensor for sensing an amount of liquid contained in the liquid container; and the prescribed process includes a process for using the sensor to determine the amount of the liquid.

7. The liquid jetting apparatus according to claim 1 wherein in the first instance, the controller electrically connects the second line and the first line to access the first device via the second line and the first line.

8. A method of controlling a liquid jetting apparatus to which a liquid container is attached, the container containing a liquid and having a first device, the apparatus includes a processor that executes a prescribed process in relation to the liquid container, a first line for electrical connection to the first device, and a second line for electrical connection to the processor, the method comprising:

in a first instance, accessing the first device via at least the first line; and in a second instance, accessing the processor via the second line to have the processor execute the prescribed process while electrically setting the first line to a fixed potential.

9. The liquid jetting apparatus according to claim 1, wherein the driving voltage is greater than a voltage of the first line not having an undesired voltage on the first line due to the prescribed process.

10. The liquid jetting apparatus according to claim 1 wherein the connecting module is electrically connected between the first device and the processor, respectively via the first and second lines.

11. The method of claim 8, wherein the first device includes a memory device, wherein the first line is between the connection module and the memory, wherein:

the container further includes a second device, the liquid jetting apparatus further includes a third line for electrically connecting the controller and the second device, and the prescribed process includes application of driving voltage to the second device through the third line, wherein the driving voltage is higher than a voltage of a power supply potential of the memory as measured from a ground potential.

* * * * *